US009996037B2

(12) United States Patent
Kaneko et al.

(10) Patent No.: US 9,996,037 B2
(45) Date of Patent: Jun. 12, 2018

(54) IMAGE FORMING APPARATUS AND IMAGE FORMING METHOD WHICH CYCLICALLY CHANGE A CHARGING POWER AND A DEVELOPING BIAS APPLIED TO A DEVELOPER BEARER

(71) Applicants: Satoshi Kaneko, Kanagawa (JP); Terumichi Ochi, Kanagawa (JP); Shuji Hirai, Tokyo (JP)

(72) Inventors: Satoshi Kaneko, Kanagawa (JP); Terumichi Ochi, Kanagawa (JP); Shuji Hirai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/447,696

(22) Filed: Mar. 2, 2017

(65) Prior Publication Data

US 2017/0269527 A1 Sep. 21, 2017

(30) Foreign Application Priority Data

Mar. 18, 2016 (JP) ..... 2016-055750

(51) Int. Cl.
*G03G 15/00* (2006.01)

(52) U.S. Cl.
CPC ..... *G03G 15/5025* (2013.01)

(58) Field of Classification Search
CPC ..... G03G 15/0266; G03G 15/065; G03G 15/5041; G03G 15/5054
USPC ..... 399/49, 50, 51, 55, 72
See application file for complete search history.

(56) References Cited

U.S. PATENT DOCUMENTS

| | | | | |
|---|---|---|---|---|
| 9,727,001 | B2 * | 8/2017 | Kaneko et al. | .... G03G 15/0266 |
| 2012/0099165 | A1 | 4/2012 | Omori et al. | |
| 2012/0201552 | A1 | 8/2012 | Hirai et al. | |
| 2013/0108288 | A1 | 5/2013 | Kaneko et al. | |
| 2013/0108292 | A1 | 5/2013 | Suzuki et al. | |
| 2013/0243456 | A1 | 9/2013 | Kaneko et al. | |
| 2013/0243457 | A1 | 9/2013 | Kaneko et al. | |
| 2013/0243459 | A1 | 9/2013 | Omori et al. | |

(Continued)

FOREIGN PATENT DOCUMENTS

| | | |
|---|---|---|
| JP | 9-062042 | 3/1997 |
| JP | 2000-098675 | 4/2000 |

(Continued)

*Primary Examiner* — William J Royer
(74) *Attorney, Agent, or Firm* — Oblon, McClelland, Maier & Neustadt, L.L.P.

(57) ABSTRACT

An image forming apparatus includes an image forming device, an image density detector, and an output change device configured to cause the image forming device to form a test toner image while cyclically changing a charging power based on a charging change pattern and a developing bias based on a developing change pattern, generate an image density fluctuation pattern of the test toner image in a rotation direction of a latent image bearer, generate a writing change pattern to cyclically change a power of latent image writing based on the image density fluctuation pattern of the test toner image and one of the charging change pattern and a correlative pattern correlated with the charging change pattern. The output change device is configured to cyclically change the power of latent image writing based on the writing change pattern during image formation according to a user command.

13 Claims, 21 Drawing Sheets

(56) References Cited

U.S. PATENT DOCUMENTS

| | | | |
|---|---|---|---|
| 2014/0064759 | A1 | 3/2014 | Komatsu et al. |
| 2014/0169814 | A1 | 6/2014 | Uematsu et al. |
| 2014/0241741 | A1 | 8/2014 | Komatsu et al. |
| 2014/0268242 | A1 | 9/2014 | Kaneko et al. |
| 2014/0270827 | A1 | 9/2014 | Muto et al. |
| 2014/0270828 | A1 | 9/2014 | Suzuki et al. |
| 2014/0301748 | A1 | 10/2014 | Suzuki et al. |
| 2015/0261162 | A1 | 9/2015 | Kaneko et al. |
| 2015/0362879 | A1 | 12/2015 | Kaneko et al. |
| 2016/0062260 | A1 | 3/2016 | Kaneko et al. |
| 2016/0124367 | A1 | 5/2016 | Kaneko et al. |
| 2016/0187807 | A1 | 6/2016 | Hirai et al. |
| 2016/0299452 | A1 | 10/2016 | Kaneko et al. |

FOREIGN PATENT DOCUMENTS

| | | |
|---|---|---|
| JP | 2007-140402 | 6/2007 |
| JP | 2012-088522 | 5/2012 |
| JP | 2012-163645 | 8/2012 |
| JP | 2013-190686 | 9/2013 |
| JP | 2013-195585 | 9/2013 |

* cited by examiner

IMAGE FORMING APPARATUS AND IMAGE FORMING METHOD WHICH CYCLICALLY CHANGE A CHARGING POWER AND A DEVELOPING BIAS APPLIED TO A DEVELOPER BEARER

CROSS-REFERENCE TO RELATED APPLICATIONS

This patent application is based on and claims priority pursuant to 35 U.S.C. § 119(a) to Japanese Patent Application No. 2016-055750, filed on Mar. 18, 2016, in the Japan Patent Office, the entire disclosure of which is hereby incorporated by reference herein.

BACKGROUND

Technical Field

Embodiments of the present invention generally relate to an image forming apparatus, such as a copier, a printer, a facsimile machine, or a multifunction peripheral having at least two of copying, printing, facsimile transmission, plotting, and scanning capabilities, and an image formation method.

Description of the Related Art

There are image forming apparatuses that cyclically change charging power of a charger to charge a latent image bearer while cyclically changing a developing bias applied to a developer bearer of a developing device during an image forming operation of an image forming device.

For example, there are image forming apparatuses that form a latent image on the latent image bearer and develop the latent image, thereby forming a toner image, while cyclically changing the charging power and the developing bias. Specifically, the developing device develops an electrostatic latent image on a photoconductor, serving as the latent image bearer, with developer borne on a developing roller (i.e., a developer bearer), to obtain a toner image. At that time, due to distortion of external shape of the photoconductor or the like, the gap (i.e., a developing gap) between the photoconductor and the developing roller may fluctuate cyclically in accordance with rotation of the photoconductor. Such fluctuations result in cyclic density fluctuation of solid image portions of the image. Typically, image forming apparatuses perform a control operation to suppress such fluctuation. For example, the developing bias is cyclically changed based on readings by a rotary encoder detecting the rotation attitude of the photoconductor and predetermined development change pattern data. Cyclically changing the developing bias can suppress the cyclic density fluctuation of solid image portions resulting from fluctuations in the development gap. Additionally, the charging bias, which is applied to the charger to uniformly charge the photoconductor, is changed cyclically. Specifically, the charging bias is cyclically changed based on the results of detection of rotation attitude of the photoconductor and predetermined charging change pattern data. This operation is to suppress cyclic density fluctuation of halftone image portions caused by cyclically changing the developing bias. Thus, the cyclic density fluctuation of solid image portions and the cyclic density fluctuation of halftone image portions are supposedly suppressed.

SUMMARY

An embodiment of the present invention provides an image forming apparatus that includes an image forming device, an image density detector to detect a density of an image formed by the image forming device, and an output change device to cyclically change a charging power and a developing bias applied to a developer bearer during image formation by the image forming device. The image forming device includes a latent image bearer, a charger to charge a surface of the latent image bearer, a latent-image writing device to write a latent image on the charged surface of the latent image bearer, and a developing device including the developer bearer to bear developer to develop the latent image.

The output change device is configured to cause the image forming device to form a test toner image for pattern generation, on the latent image bearer, while cyclically changing the charging power based on a charging change pattern and the developing bias based on a developing change pattern. Further, the output change device is configured to generate, based on a detection result of the image density detector, an image density fluctuation pattern of the test toner image for pattern generation, the image density fluctuation pattern generated in a rotation direction of the latent image bearer. Further, the output change device is configured to perform pattern generation processing to generate a writing change pattern to cyclically change a power of latent image writing by the latent-image writing device, based on the image density fluctuation pattern of the test toner image for pattern generation, and one of the charging change pattern and a correlative pattern correlated with the charging change pattern. Further, the output change device is configured to cyclically change the power of latent image writing based on the writing change pattern during image formation according to a user command.

In another embodiment, an image forming method includes forming a test toner image for pattern generation, on a latent image bearer while cyclically changing a charging power based on a charging change pattern and a developing bias applied to a developer bearer based on a developing change pattern; generating an image density fluctuation pattern of the test toner image for pattern generation in a rotation direction of the latent image bearer; generating a writing change pattern to cyclically change a power of latent image writing based on the image density fluctuation pattern of the test toner image for pattern generation and one of the charging change pattern and a correlative pattern correlated with the charging change pattern; and performing output change processing during image formation according to a user command. The output change processing includes cyclically changing the charging power based on the charging change pattern, cyclically changing the developing bias based on the developing change pattern, and cyclically changing the power of latent image writing based on the writing change pattern.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
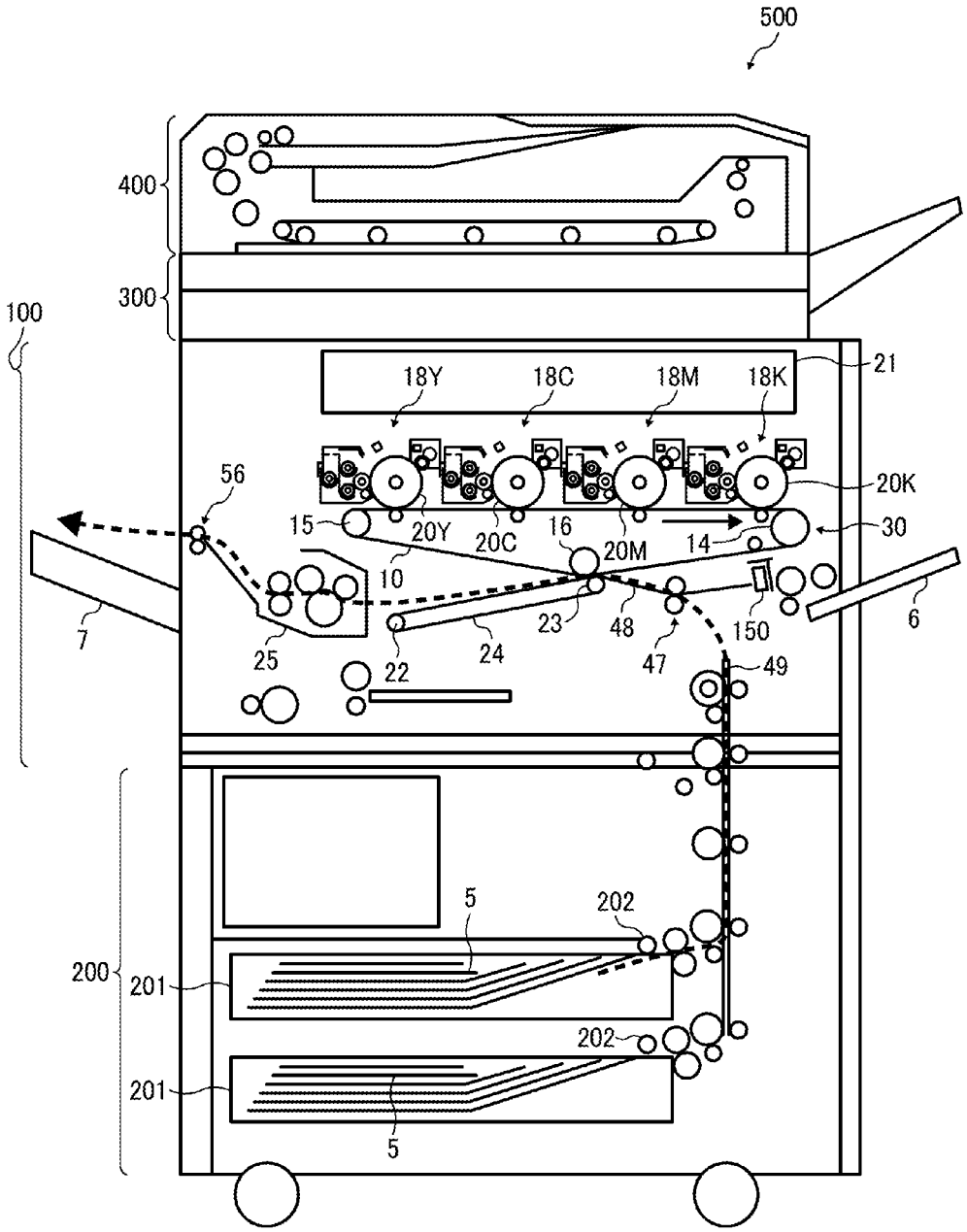
FIG. 1 is a schematic view of an image forming apparatus, such as a copier, according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus employing electrophotography, according to an embodiment of the present invention is described. As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Descriptions are given below of a basic structure of an image forming apparatus, such as a copier (hereinafter, simply "copier"), to which one or more of aspects of the present disclosure is applied. FIG. 1 is a schematic view of a copier 500. As illustrated in FIG. 1, the copier 500 includes an image forming section 100 to form an image on a recording sheet, a sheet feeder 200 to supply a recording sheet 5 to the image forming section 100, and a scanner 300 to read an image on a document. In addition, an automatic document feeder (ADF) 400 is disposed above the scanner 300. The image forming section 100 includes a bypass feeder 6 (i.e., a side tray) to feed a recording sheet different from the recording sheets 5 contained in the sheet feeder 200, and a stack tray 7 to stack the recording sheet 5 after an image has been formed thereon.

Figure 2:
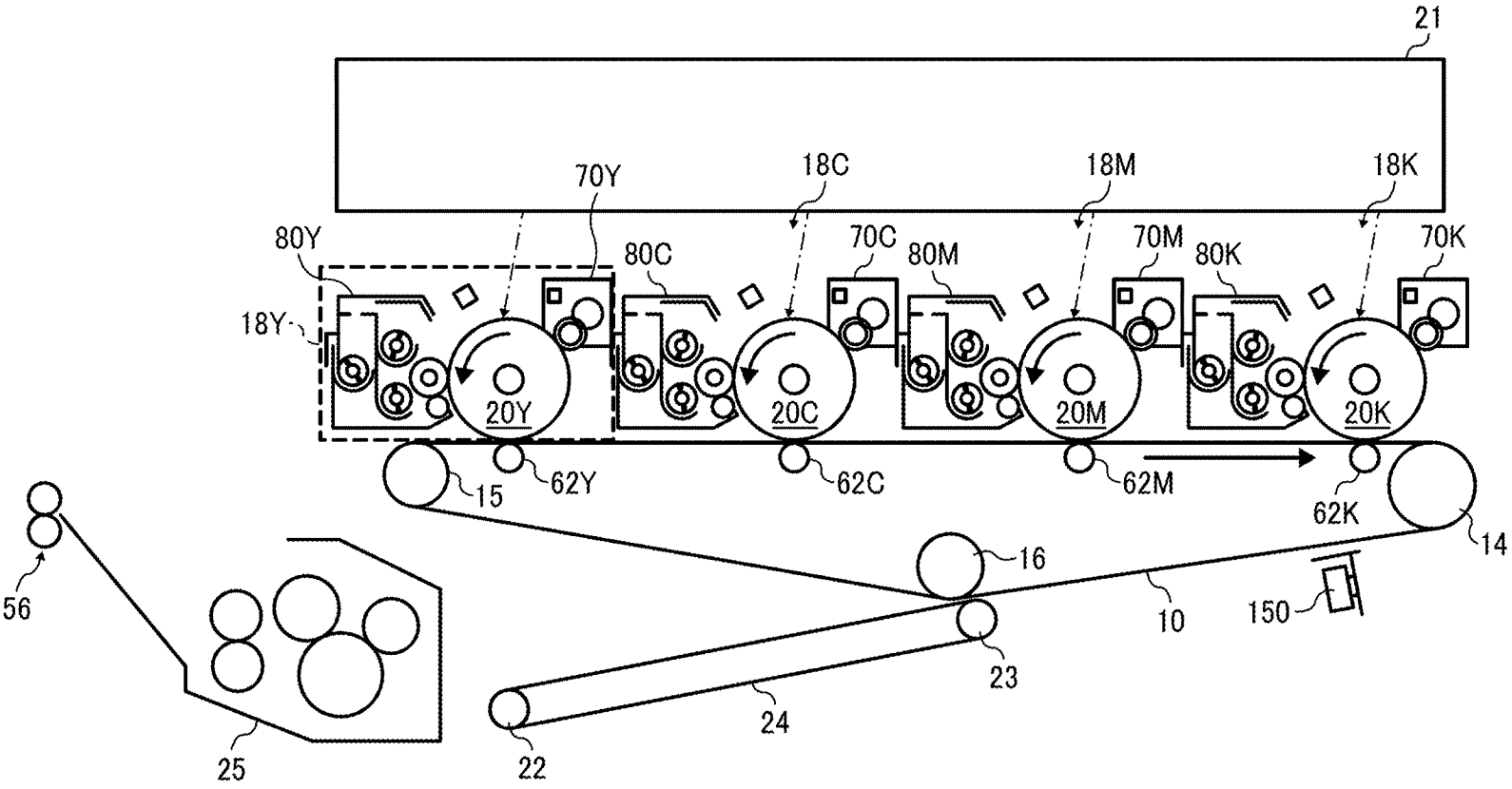
FIG. 2 is an enlarged view illustrating an image forming section of the copier illustrated in FIG. 1.

FIG. 2 is an enlarged view of the image forming section 100. The image forming section 100 includes a transfer unit 30 including an intermediate transfer belt 10, which is an endless belt serving as a transfer member. The intermediate transfer belt 10 of the transfer unit 30 is stretched around three support rollers 14, 15, and 16 and moves endlessly clockwise in FIGS. 1 and 2, as one of the three support rollers 14, 15, and 16 rotates. Four image forming units corresponding to yellow (Y), cyan (C), magenta (M), and black (K), respectively, are disposed opposite the outer side of a portion of the intermediate transfer belt 10 moving between the support roller 14 and the support roller 15. An optical sensor unit 150 to detect an image density (that is, toner adhesion amount per unit area) of a toner image on the intermediate transfer belt 10 is disposed opposite the outer face of a portion of the intermediate transfer belt 10 moving between the support roller 14 and the support roller 16. The optical sensor unit 150 serves as an image density detector.

In FIG. 1, a laser writing device 21 is disposed above image forming units 18Y, 18C, 18M, and 18K. The laser writing device 21 emits writing light based on image data read by the scanner 300 or image data sent from an external device such as a personal computer. Specifically, based on the image data, a laser controller drives a semiconductor laser to emit the writing light. The writing light exposes and scans each of a plurality of the drum-shaped photoconductors 20Y, 20C, 20M, and 20K, serving as latent image bearers, of the image forming units 18Y, 18C, 18M, and 18K, thereby forming an electrostatic latent image thereon. The light source of the writing light is not limited to a laser diode but can be a light-emitting diode (LED), for example. The image forming units further 18Y, 18C, 18M, and 18K further include charging devices 70Y, 70C, 70M, and 70K and developing devices 80Y, 80C, 80M, and 80K, respectively.

Figure 3:
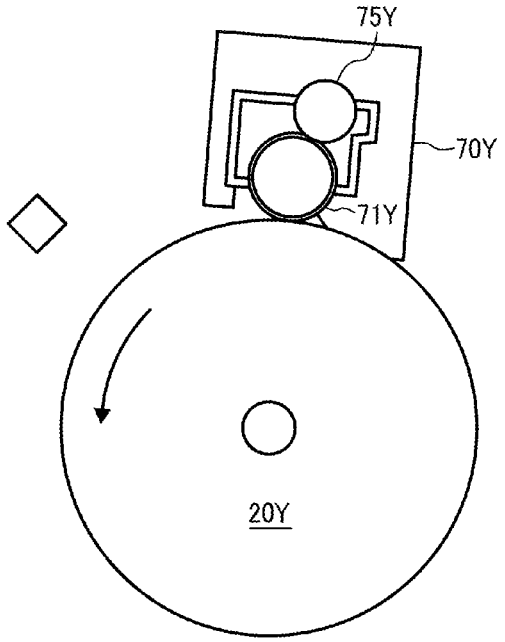
FIG. 3 is an enlarged view illustrating a photoconductor and a charging device for yellow in the image forming section illustrated in FIG. 2.

FIG. 3 is an enlarged view of the photoconductor 20Y and the charging device 70Y for yellow. Components for forming yellow images will be described as representatives. The charging device 70Y includes a charging roller 71Y that contacts the photoconductor 20Y to rotate following the rotation of the photoconductor 20Y, a charging roller cleaner 75Y (e.g., a cleaning roller) that contacts the charging roller 71Y to rotate following the rotation of the charging roller 71Y, and a photoconductor rotation sensor 76Y illustrated in FIG. 4, serving as a rotation attitude sensor, which is described later.

Figure 4:
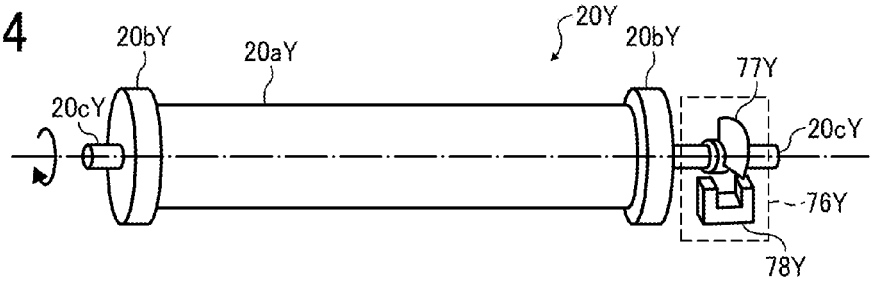
FIG. 4 is an enlarged perspective view illustrating the photoconductor illustrated in FIG. 3.

FIG. 4 is an enlarged view of the photoconductor 20Y for yellow. The photoconductor 20Y includes a columnar body 20*a*Y, large-diameter flanges 20*b*Y disposed at both ends of the columnar body 20*a*Y in the axial direction thereof, and a rotation shaft 20*c*Y rotatably supported by bearings.

One end of the rotation shaft 20*c*Y, which protrudes from the end face of each of the two flanges 20*b*Y, penetrates the photoconductor rotation sensor 76Y, and the portion protruding from the photoconductor rotation sensor 76Y is received by the bearing. The photoconductor rotation sensor 76Y includes a light shield 77Y secured to the rotation shaft 20*c*Y to rotate together with the rotation shaft 20*c*Y, and a transmission photosensor 78Y. The light shield 77Y has a shape protruding from a predetermined position on the rotation shaft 20*c*Y in the direction normal to the rotation shaft 20*c*Y. When the photoconductor 20Y takes a predetermined rotation attitude, the light shield 77Y is interposed between a light-emitting element and a light-receiving element of the transmission photosensor 78Y. With this structure, when the light-receiving element does not receive light, the voltage output from the transmission photosensor 78Y decreases significantly. Specifically, detecting the photoconductor 20Y being in a predetermined rotation attitude, the transmission photosensor 78Y significantly decreases the output voltage.

Figure 5:
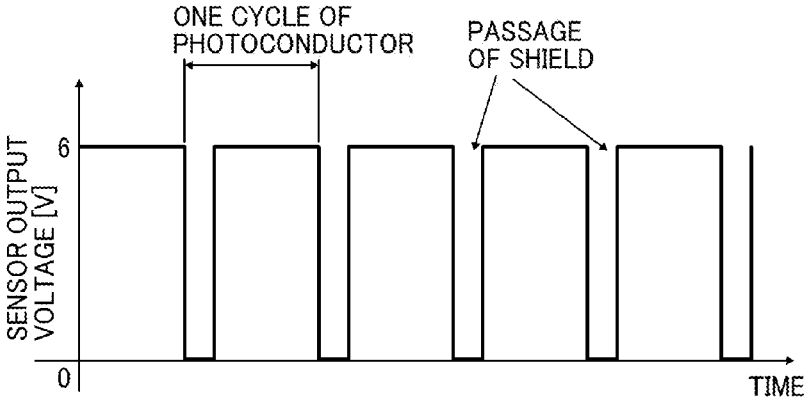
FIG. 5 is a graph illustrating a change with time in output voltage from a photoconductor rotation sensor for yellow in the image forming section illustrated in FIG. 2.

FIG. 5 is a graph illustrating changes with time in the output voltage from the photoconductor rotation sensor 76Y for yellow. More specifically, the output voltage from the photoconductor rotation sensor 76Y is an output voltage from the transmission photosensor 78Y. As illustrated in FIG. 5, the photoconductor rotation sensor 76Y outputs a predetermined voltage (e.g., 6 volts) most of time during which the photoconductor 20Y rotates. However, each time the photoconductor 20Y makes a complete turn, the output voltage from the photoconductor rotation sensor 76Y instantaneously falls to nearly 0 volt. Specifically, each time the photoconductor 20Y makes a complete turn, the light shield 77Y is interposed between the light-emitting element and the light-receiving element of the transmission photosensor 78Y, thus blocking the light to be received by the light-receiving element. The output voltage greatly decreases at a timing when the photoconductor 20Y is in a predetermined rotation attitude. Hereinafter, the timing is called "reference attitude timing."

Referring back to FIG. 3, the charging roller cleaner 75Y of the charging device 70Y includes a conductive core bar and an elastic layer overlying the core bar. The elastic layer, which is a sponge body produced by foaming or expanding melamine resin to have micro pores, rotates while contacting the charging roller 71Y. While rotating, the charging roller cleaner 75 removes dust, residual toner, and the like from the charging roller 71Y to suppress creation of substandard images.

Referring back to FIG. 2, the four image forming units 18Y, 18C, 18M, and 18K are similar in structure, except the color of toner used therein. For example, the image forming unit 18Y to form yellow toner images includes the photoconductor 20Y, the charging device 70Y, and the developing device 80Y.

The charging device 70Y charges the surface of the photoconductor 20Y uniformly to a negative polarity. Of the uniformly charged surface of the photoconductor 20Y, the portion irradiated with the laser light from the laser writing device 21 has an attenuated potential and becomes an electrostatic latent image.

Figure 6:
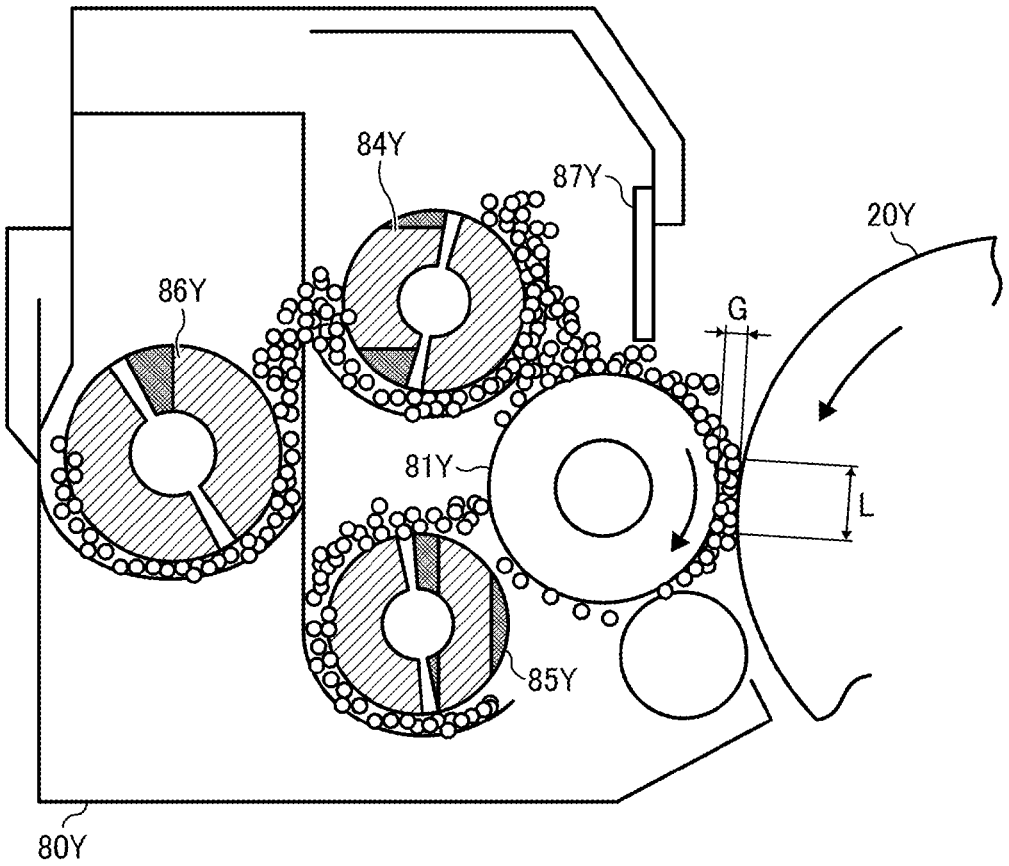
FIG. 6 is a schematic cross-sectional view of a developing device and the photoconductor in the image forming section.

FIG. 6 schematically illustrates the developing device 80Y for yellow and a portion of the photoconductor 20Y for yellow. The developing device 80Y employs two-component development in which two-component developer including magnetic carriers and nonmagnetic toner is used for image developing. Alternatively, one-component development using one-component developer that does not include magnetic carriers may be employed. The developing device 80Y includes a stirring section and a developing section within a development case. In the stirring section, the two-component developer (hereinafter, simply "developer") is stirred by three screws (a supply screw 84Y, a collecting screw 85Y, and a stirring screw 86Y) and is conveyed to the developing section.

The developing section includes a rotary developing sleeve 81Y disposed opposite the photoconductor 20Y via an opening of the development case, across a predetermined development gap G. The developing sleeve 81Y serving as a developer bearer includes a magnet roller, which does not rotate together with the developing sleeve 81Y.

The supply screw 84Y and the collecting screw 85Y in the stirring section and the developing sleeve 81Y in the developing section extend in a horizontal direction and are parallel to each other. By contrast, the stirring screw 86Y in the stirring section is inclined to rise from the front side to the backside of the paper on which FIG. 6 is drawn.

While rotating, the supply screw 84Y of the stirring section conveys the developer from the backside to the front side of the paper on which FIG. 6 is drawn to supply the developer to the developing sleeve 81Y of the developing section. The developer that is not supplied to the developing sleeve 81Y but is conveyed to the front end of the development case in the above-mentioned direction falls to the collecting screw 85Y disposed immediately below the supply screw 84Y.

The developer supplied to the developing sleeve 81Y by the supply screw 84Y of the stirring section is scooped up onto the developing sleeve 81Y due to the magnetic force exerted by the magnet roller inside the developing sleeve 81Y. The magnetic force of the magnet roller causes the scooped developer to stand on end on the surface of the developing sleeve 81Y, forming a magnetic brush. As the developing sleeve 81Y rotates, the developer passes through a regulation gap between a leading end of a regulation blade 87Y and the developing sleeve 81Y, where the thickness of a layer of developer on the developing sleeve 81Y is regulated. Then, the developer is conveyed to a developing range opposite the photoconductor 20Y.

In the developing range, the developing bias applied to the developing sleeve 81Y causes a developing potential. The developing potential gives an electrostatic force trending to the electrostatic latent image to the toner of developer located facing the electrostatic latent image on the photoconductor 20Y. In addition, background potential acts on the toner located facing a background portion on the photoconductor 20Y, of the toner in the developer. The background potential gives an electrostatic force trending to the surface of the developing sleeve 81Y. As a result, the toner moves to the electrostatic latent image on the photoconductor 20Y, developing the electrostatic latent image. Thus, a yellow toner image is formed on the photoconductor 20Y. The yellow toner image enters a primary transfer nip for yellow as the photoconductor 20Y rotates.

As the developing sleeve 81Y rotates, the developer that has passed through the developing range reaches an area where the magnetic force of the magnet roller is weaker. Then, the developer leaves the developing sleeve 81Y and returns to the collecting screw 85Y of the stirring section. While rotating, the collecting screw 85Y conveys the developer collected from the developing sleeve 81Y from the backside to the front side of the paper on which FIG. 6 is drawn. At the front end of the developing device 80Y in the above-mentioned direction, the developer is received to the stirring screw 86Y.

While rotating, the stirring screw 86Y conveys the developer received from the collecting screw 85Y to the backside from the front side in the above-mentioned direction. During this process, a toner concentration sensor 82Y, which is a magnetic permeability sensor as an example, (described later referring to FIGS. 7A and 7B), detects the concentration of toner or toner density. Based on the detection result, toner is supplied as required. Specifically, to supply toner, a controller 110 (illustrated in FIGS. 7A and 7B) drives a toner supply device according to the readings of the toner concentration sensor 82Y. The developer to which the toner is thus supplied is conveyed to the back end of the development case in the above-mentioned direction and is received by the supply screw 84Y.

The length of the developing range (hereinafter "developing range length L") in the direction in which the developing sleeve 81Y rotates varies depending on the diameter of the developing sleeve 81Y, the development gap G, the regulation gap, and the like. As the developing range length L increases, the chance for the toner to contact the electrostatic latent image on the photoconductor 20Y increases in the developing range.

Thus, the developing efficiency improves. Therefore, increasing the developing range length L is preferable for a high-speed printing. However, an excessively long developing range length L increases the possibility of conveniences such as toner scattering, toner adhesion, and lock of rotation of the photoconductor 20Y. Thus, the developing range length L needs to be set in accordance with machine specifications.

The description above concerns formation of yellow images in the image forming unit 18Y for yellow. In the image forming units 18C, 18M, and 18K, cyan, magenta, and black toner images are formed on the photoconductors 20C, 20M, and 20K, respectively, through similar processes.

In FIG. 2, primary transfer rollers 62Y, 62C, 62M, and 62K are disposed inside the loop of the intermediate transfer belt 10 and nip the intermediate transfer belt 10 together with the photoconductors 20Y, 20C, 20M, and 20K. Accordingly, the outer face (front side) of the intermediate transfer belt 10 contacts the photoconductors 20Y, 20M, 20C, and 20K, and the contact portions therebetween serve as primary transfer nips for yellow, magenta, cyan, and black, respectively. Primary electrical fields are respectively generated between the primary transfer rollers 62Y, 62C, 62M, and 62K and the photoconductors 20Y, 20C, 20M, and 20K, to each of which the primary transfer bias is applied.

The outer face of the intermediate transfer belt 10 sequentially passes the primary transfer nips for yellow, cyan, magenta, and black as the intermediate transfer belt 10 rotates.

During such a process, yellow, magenta, cyan, and black toner images are sequentially transferred from the photoconductors 20Y, 20C, 20M, and 20K and superimposed on the outer face of the intermediate transfer belt 10 (i.e., primary transfer process). Thus, a four-color superimposed toner image is formed on the outer face of the intermediate transfer belt 10.

Below the intermediate transfer belt 10, an endless conveyor belt 24 is stretched around a first tension roller 22 and a second tension roller 23. The conveyor belt 24 rotates counterclockwise in the drawing as one of the tension rollers 22 and 23 rotates. The outer face of the conveyor belt 24 contacts a portion of the intermediate transfer belt 10 winding around the support roller 16, and the contact portion therebetween is called "secondary transfer nip." Around the secondary transfer nip, a secondary transfer electrical field is generated between the second tension roller 23, which is grounded, and the support roller 16, to which a secondary transfer bias is applied.

Referring back to FIG. 1, the image forming section 100 includes a conveyance path 48, through which the recording sheet 5 fed from the sheet feeder 200 or the bypass feeder 6 is sequentially transported to the secondary transfer nip, a fixing device 25 described later, and an ejection roller pair 56. The image forming section 100 includes another conveyance path 49 to convey the recording sheet 5 fed to the image forming section 100 from the sheet feeder 200 to an entrance of the conveyance path 48. A registration roller pair 47 is disposed at the entrance of the conveyance path 48.

When a print job is started, the recording sheet 5, fed from the sheet feeder 200 or the bypass feeder 6, is conveyed to the conveyance path 48. The recording sheet 5 then abuts against the registration roller pair 47. The registration roller pair 47 starts rotation at a proper timing, thereby sending the recording sheet 5 toward the secondary transfer nip. In the secondary transfer nip, the four-color superimposed toner image on the intermediate transfer belt 10 tightly contacts the recording sheet 5. The four-color superimposed toner image is secondarily transferred en bloc onto the surface of the recording sheet 5 due to effects of the secondary transfer electrical field and nip pressure. Thus, a full-color toner image is formed on the recording sheet 5.

The conveyor belt 24 conveys the recording sheet 5 that has passed through the secondary transfer nip to the fixing device 25. The recording sheet 5 is pressed and heated inside the fixing device 25, thereby the full-color toner image is fixed on the surface of the recording sheet 5. After discharged from the fixing device 25, the recording sheet 5 is conveyed to the ejection roller pair 56 and ejected onto the stack tray 7.

Figure 7A:
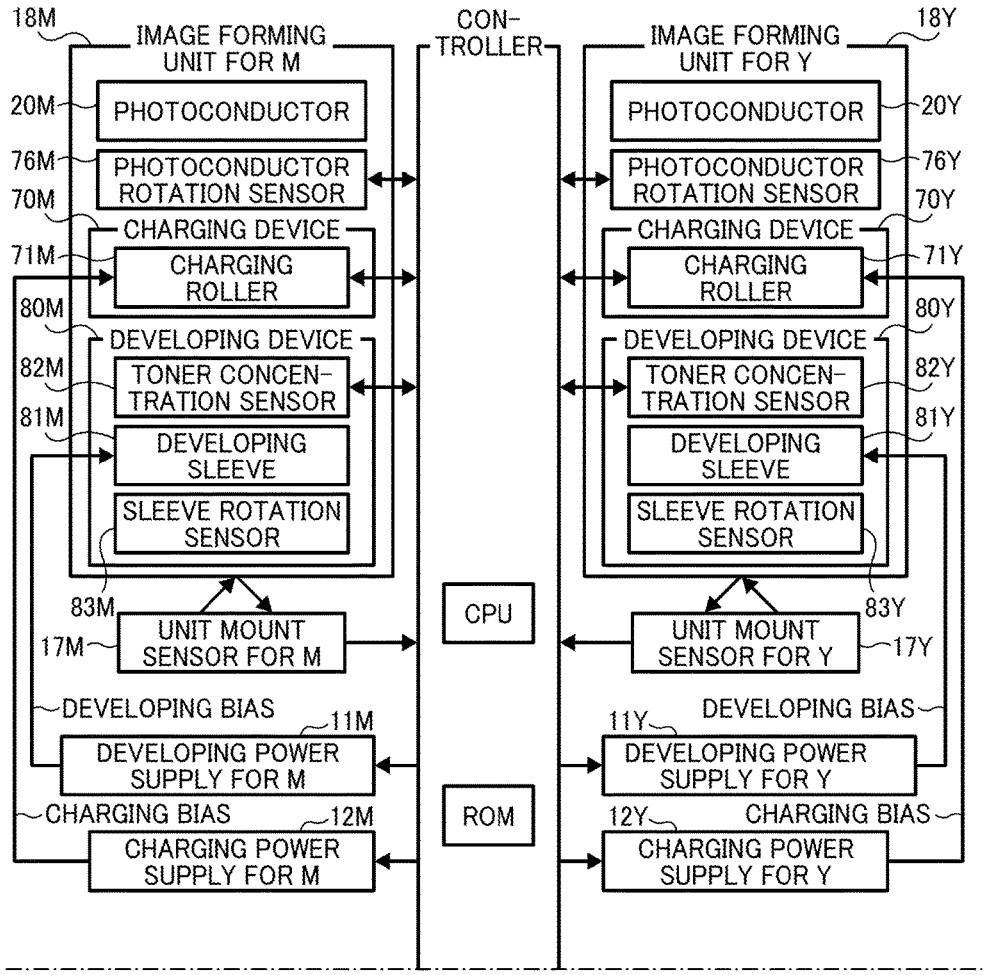
FIGS. 7A and 7B are block diagrams illustrating a main part of electric circuitry of the copier illustrated in FIG. 1.
Figure 7B:
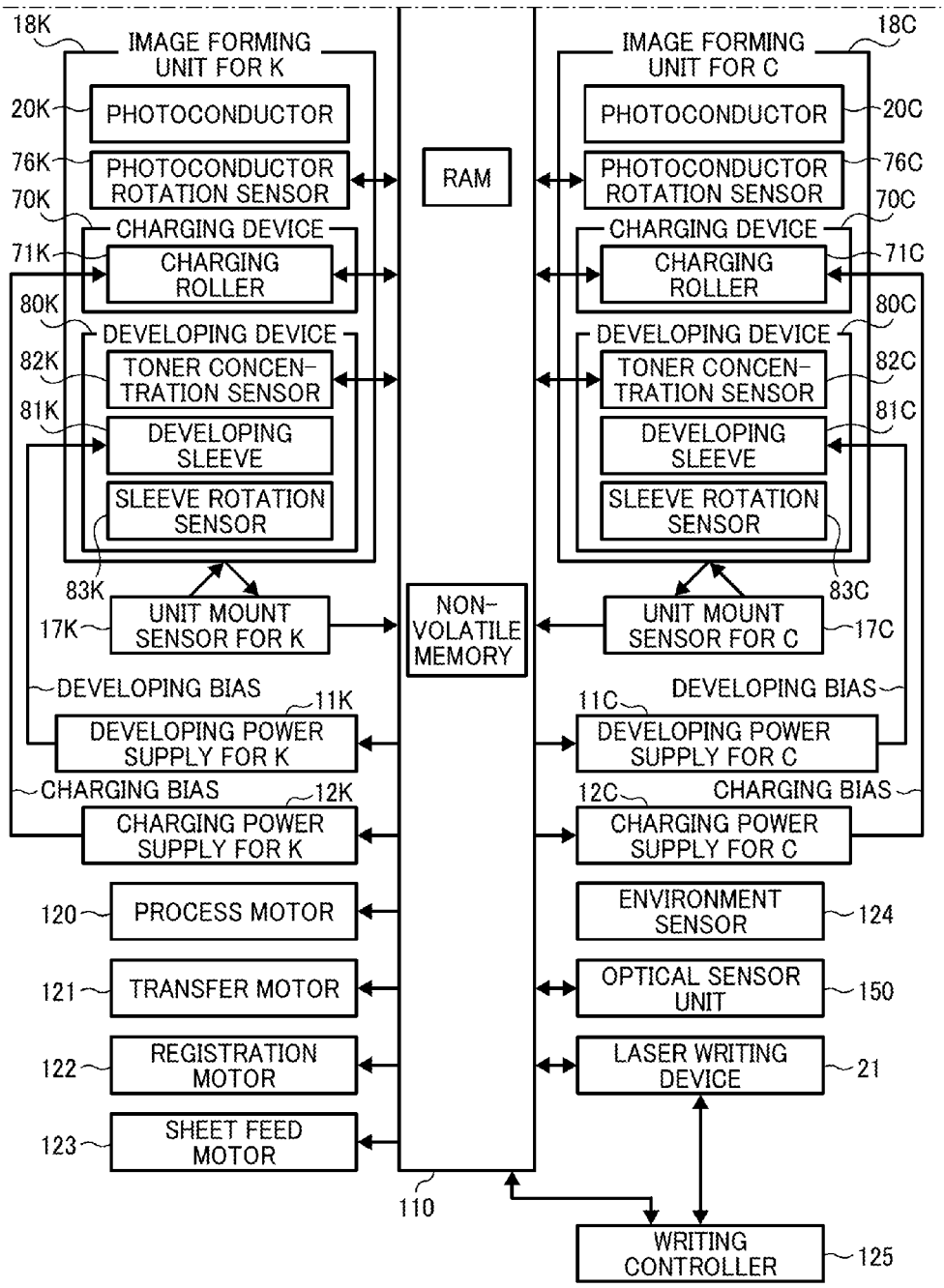

FIGS. 7A and 7B are block diagrams illustrating a main part of electric circuitry of the copier 500. In the configuration illustrated in FIGS. 7A and 7B, the controller 110 includes a central processing unit (CPU), a random access memory (RAM), a read only memory (ROM), a nonvolatile memory, and the like. The toner concentration sensors 82Y, 82C, 82M, and 82K of the yellow, cyan, magenta, and black developing devices 80Y, 80C, 80M, and 80K, respectively, are electrically connected to the controller 110. With this structure, the controller 110 obtains the toner concentration of yellow developer, cyan developer, magenta developer, and black developer contained in the developing devices 80Y, 80C, 80M, and 80K, respectively.

Unit mount sensors 17Y, 17C, 17M, and 17K for yellow, cyan, magenta, and black, serving as replacement detectors, are also electrically connected to the controller 110. The unit mount sensors 17Y, 17C, 17M, and 17K respectively detect removal of the image forming units 18Y, 18C, 18M, and 18K from the image forming section 100 and mounting thereof in the image forming section 100. With this structure, the controller 110 recognizes that the image forming units 18Y, 18C, 18M, and 18K have been mounted in or removed from the image forming section 100.

In addition, developing power supplies 11Y, 11C, 11M, and 11K for yellow, cyan, magenta, and black are electrically connected to the controller 110. The controller 110 outputs control signals to the developing power supplies 11Y, 11C, 11M, and 11K respectively, to individually adjust the value of developing bias output from each of the developing power supplies 11Y, 11C, 11M, and 11K. That is, the values of developing biases applied to the developing sleeves 81Y, 81C, 81M, and 81K for yellow, cyan, magenta, and black can be individually adjusted.

In addition, charging power supplies 12Y, 12C, 12M, and 12K for yellow, cyan, magenta, and black are electrically connected to the controller 110. The controller 110 outputs control signals to the charging power supplies 12Y, 12C, 12M, and 12K, respectively, to adjust the value of direct current (DC) voltage in the charging bias output from each of the charging power supplies 12Y, 12C, 12M, and 12K, individually. That is, the values of direct current voltage in the charging biases applied to the charging rollers 71Y, 71C, 71M, and 71K for yellow, cyan, magenta, and black can be individually adjusted.

In addition, the photoconductor rotation sensors 76Y, 76C, 76M, and 76K to individually detect the photoconductors 20Y, 20C, 20M, and 20K for yellow, cyan, magenta, and black being in the predetermined rotation attitude are electrically connected to the controller 110. Accordingly, based on the detection output from the photoconductor rotation sensors 76Y, 76C, 76M, and 76K, the controller 110 individually recognizes whether or not each of the photoconductors 20Y, 20C, 20M, and 20K for yellow, cyan, magenta, and black is in the predetermined rotation attitude.

Sleeve rotation sensors 83Y, 83C, 83M, and 83K of the developing devices 80Y, 80C, 80M, and 80K, respectively, are also electrically connected to the controller 110. The sleeve rotation sensors 83Y, 83C, 83M, and 83K, each serving as a rotation attitude sensor, are similar in structure to the photoconductor rotation sensors 76Y, 76C, 76M, and 76K and configured to detect the developing sleeves 81Y, 81C, 81M, and 81K being in predetermined rotation attitudes, respectively. In other words, based on the detection output from the sleeve rotation sensors 83Y, 83C, 83M, and 83K, the controller 110 individually recognizes the timing at which each of the developing sleeves 81Y, 81C, 81M, and 81K takes the predetermined rotation attitude.

In addition, a writing controller 125, an environment sensor 124, the optical sensor unit 150, a process motor 120, a transfer motor 121, a registration motor 122, a sheet feed motor 123, and the like are electrically connected to the controller 110. The environment sensor 124 detects the temperature and the humidity inside the apparatus. The process motor 120 is a drive source for the image forming units 18Y, 18C, 18M, and 18K. The transfer motor 121 is a drive source for the intermediate transfer belt 10. The registration motor 122 is a drive source for the registration roller pair 47. The sheet feed motor 123 is a drive source to drive pickup rollers 202 to send out the recording sheet 5 from sheet trays 201 of the sheet feeder 200. The writing controller 125 controls driving of the laser writing device 21 based on the image data. The function of the optical sensor unit 150 will be described later.

The copier 500 according to the present embodiment performs a control operation called "process control" regularly at predetermined timings to stabilize the image density over a long time regardless of environmental changes or the like. In the process control, a yellow patch pattern image (a toner image) including multiple patch-shaped yellow toner images (i.e., toner patches) is formed on the photoconductor 20Y and transferred onto the intermediate transfer belt 10. Each of the patch-shaped yellow toner images is used for detecting the amount of yellow toner adhering. The controller 110 similarly forms cyan, magenta, and black patch pattern images on the photoconductors 20C, 20M, and 20K, respectively, and transfers the patch pattern images onto the intermediate transfer belt 10 so as not to overlap each other. Then, the optical sensor unit 150 detects a toner adhesion amount of each toner patch in the patch pattern image of each color. Subsequently, based on the readings obtained, image forming conditions, such as a developing bias reference value being a reference value of the developing bias Vb, are adjusted individually for each of the image forming units 18Y, 18C, 18M, and 18K.

The optical sensor unit 150 includes four reflective photosensors lined in the width direction of the intermediate transfer belt 10, which is hereinafter referred to as "belt width direction," at predetermined intervals. Each reflective photosensor outputs a signal corresponding to the reflectance light on the intermediate transfer belt 10 or the patch-shaped toner image on the intermediate transfer belt 10. Three of the four reflective photosensors capture both of specular reflection light and diffuse reflection light on the belt surface and output signals according to the amount of respective light amounts so that the output signal correspond to the adhesion amount of the corresponding one of yellow, magenta, and cyan toners.

Figure 8:
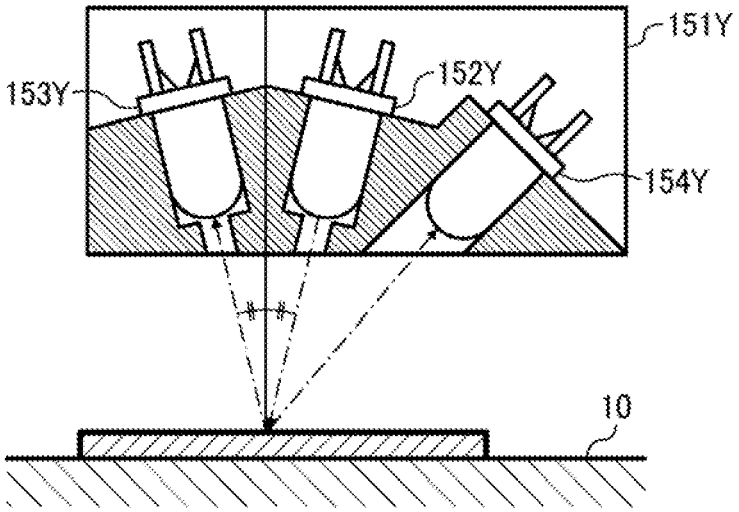
FIG. 8 is an enlarged view of a reflective photosensor for yellow mounted on an optical sensor unit of the copier illustrated in FIG. 1.

FIG. 8 is an enlarged view of a reflective photosensor 151Y for yellow mounted in the optical sensor unit 150. The reflective photosensor 151Y includes a light-emitting diode (LED) 152Y as a light source, a light-receiving element 153Y that receives the specular reflection light, and a light-receiving element 154Y that receives the diffused reflection light. The light-receiving element 153Y outputs a voltage corresponding to the amount of specular reflection light on the surface of the yellow toner patch (shaped toner image). The light-receiving element 154Y outputs a voltage corresponding to the amount of diffuse reflection light on the surface of the yellow toner patch (patch-shaped toner image). The controller 110 calculates the amount of yellow toner adhering to the yellow toner patch based on the output voltage. The reflective photosensors 151C and 151M for cyan and magenta are similar in structure to the reflective photosensor 151Y for yellow described above.

Figure 9:
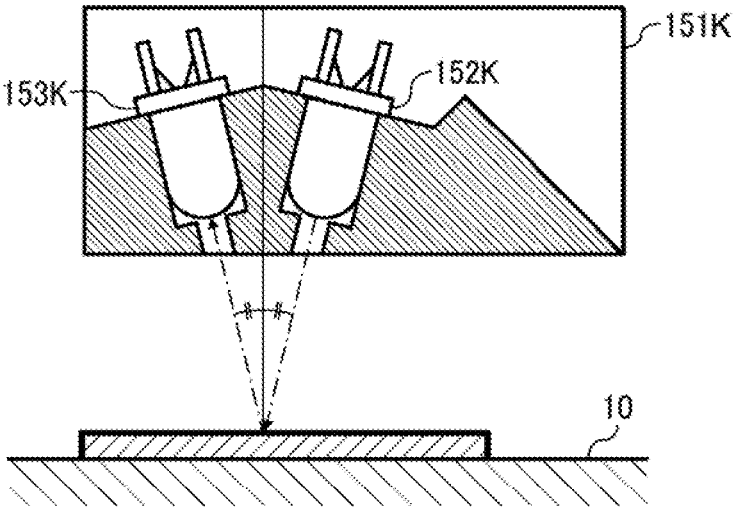
FIG. 9 is an enlarged view of a reflective photosensor for black mounted on the optical sensor unit illustrated in FIG. 8.
Figure 10:
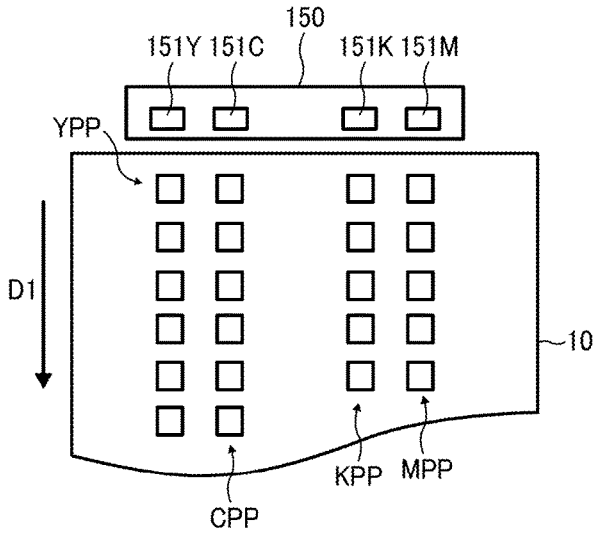
FIG. 10 illustrates a patch pattern image for each color transferred onto an intermediate transfer belt, according to an embodiment.

FIG. 9 is an enlarged view of a reflective photosensor 151K for black, mounted in the optical sensor unit 150. Arrow D1 in FIG. 10 represents the travel direction of the intermediate transfer belt 10, which is hereinafter referred to as "belt travel direction D1." The reflective photosensor 151K includes an LED 152K, serving as a light source, and a light-receiving element 153K that receives specular reflection light. The light-receiving element 153K outputs a voltage corresponding to the amount of specular reflection light on the surface of the black toner patch. The controller 110 calculates the toner adhesion amount of the black toner patch based on the output voltage.

In the present embodiment, the LED 152 for each color employs a gallium arsenide (GaAs) infrared light-emitting diode to emit light having a peak wavelength of 950 nm. For the light-receiving elements 153 to receive specular reflection and the light-receiving elements 154 to receive diffuse reflection, silicon (Si) photo transistors having a peak light receiving sensitivity of 800 nm are used. However, the peak wavelength and the peak light receiving sensitivity are not limited to the values mentioned above.

The four reflective photosensors are disposed at approximately 5 millimeters from the outer face of the intermediate transfer belt 10.

The controller 110 performs the process control at a predetermined timing, such as, turning on of a main power, standby time after elapse of a predetermined period, and standby time after printing on a predetermined number of sheets or greater. When the process control is started, initially, the controller 110 obtains information such as the number of sheets fed, coverage rate, and environmental information such as temperature and humidity and the controller 110 ascertains individual development properties in the image forming units 18Y, 18C, 18M, and 18K. Specifically, the controller 110 calculates development γ and development threshold voltage for each color. More specifically, the controller 110 causes the charging devices 70Y, 70C, 70M, and 70K to uniformly charge the photoconductors 20Y, 20C, 20M, and 20K while rotating the photoconductors 20Y, 20C, 20M, and 20K. In the charging, the charging power supplies 12Y, 12C, 12M, and 12K output charging biases different from those for normal printing. More specifically, of the charging bias, which a superimposed bias including the direct current voltage and the alternating current voltage, the direct current voltage is not set constant but is gradually increased in absolute value. The laser writing device 21 scans, with the laser light, the photoconductors 20Y, 20C, 20M, and 20K charged under such conditions, to form a plurality of electrostatic latent images for the patch-shaped toner image of yellow, cyan, magenta, and black. The developing devices 80Y, 80C, 80M, and 80K develop the latent images thus formed, respectively, to form the patch pattern images of yellow, cyan, magenta, and black on the photoconductors 20Y, 20C, 20M, and 20K. In the developing, the controller 110 gradually increases the absolute value of each of developing biases applied to the developing sleeves 81Y, 81C, 81M, and 81K. At that time, the electrostatic latent image potential of each patch-shaped toner image and the developing potential, which is the difference between the electrostatic latent image potential and the developing bias, are stored in the RAM.

As illustrated in FIG. 10, patch pattern images YPP, CPP, MPP, and KPP of yellow, cyan, magenta, and black (collectively "patch pattern images PP") are arranged in the belt width direction so as not to overlap each other on the intermediate transfer belt 10. Specifically, the patch pattern image YPP is disposed on a first end side (on the left in FIG. 10) of the intermediate transfer belt 10 in the belt width direction. The patch pattern image CPP is disposed at a position shifted to a center from the patch pattern image YPP in the belt width direction. The patch pattern image MPP is disposed on a second end side (on the right in FIG. 10) of the intermediate transfer belt 10 in the belt width direction. The patch pattern image KPP is disposed at a position shifted to the center from the patch pattern image MPP in the belt width direction.

The optical sensor unit 150 includes the reflective photosensor 151Y for yellow, the reflective photosensor 151C for cyan, the reflective photosensor 151K for black, and the reflective photosensor 151M for magenta to detect the light reflection characteristics of the intermediate transfer belt 10 at different positions in the belt width direction.

The reflective photosensor 151Y is disposed to detect the amount of toner adhering to the yellow toner patches in the patch pattern image YPP on the first end side of the intermediate transfer belt 10 in the belt width direction. The reflective photosensor 151C is disposed to detect the amount of toner adhering to the cyan toner patches in the patch pattern image CPP close to the toner patch pattern YPP in the belt width direction. The reflective photosensor 151M is disposed to detect the amount of toner adhering to the magenta toner patches in the patch pattern image MPP on the second end side of the intermediate transfer belt 10 in the belt width direction. The reflective photosensor 151K is disposed to detect the amount of toner adhering to the black toner patches of the patch pattern image KPP close to the patch pattern image MPP in the belt width direction.

Based on the signals sequentially output from the four reflective photosensors (151Y, 151C, 151M, and 151K) of the optical sensor unit 150, the controller 110 calculates the reflectance of light of the toner patches of four colors, obtains the amount of toner adhering (i.e., toner adhesion amount) to each toner patch based on the computation result, and stores the calculated toner adhesion amounts in the RAM. After passing by the position facing the optical sensor unit 150 as the intermediate transfer belt 10 rotates, the toner patch patterns PP are removed from the intermediate transfer belt 10 by a cleaning device.

Figure 11:
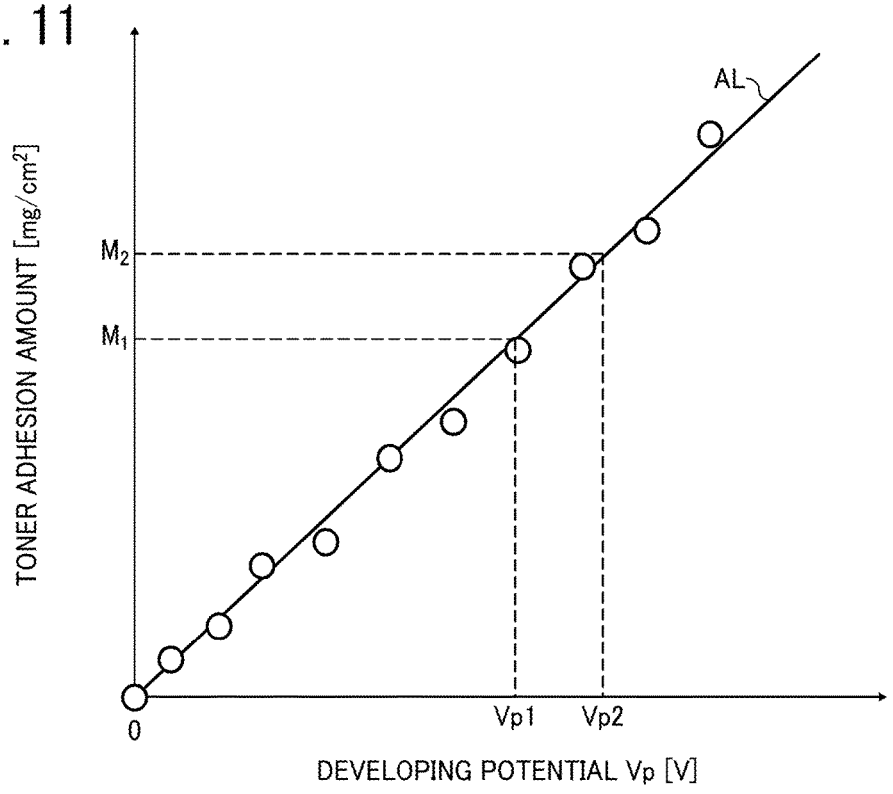
FIG. 11 is a graph of an approximation line representing a relation between toner adhesion amount and developing bias, constructed in process control processing.

The controller 110 calculates a linear approximation formula $Y=a\times Vp+b$, based on the toner adhesion amount stored in the RAM and data on the latent image potential and developing bias Vb regarding each toner patch stored in the RAM separately from the toner adhesion amount. Specifically, controller 110 calculates a formula of approximate straight line (AL in FIG. 11) representing the relation between the toner adhesion amount (Y-axis) and the developing potential (X-axis) in X-Y coordinate, as illustrated in FIG. 11. Based on the formula of approximate straight line, the controller 110 obtains a developing potential Vp (e.g., Vp1 or Vp2 in FIG. 11) to achieve a target toner adhesion amount (e.g., $M_1$ or $M_2$ in FIG. 11) and further obtains the developing bias reference value and the charging bias reference value (and laser diode power or LD power) to achieve the developing potential Vp. The obtained results are stored in the nonvolatile memory. The controller 110 performs calculation and recording of the developing bias reference value and the charging bias reference value (and LD power) for each of yellow, cyan, magenta, and black and terminates the process control. Thereafter, when the controller 110 runs a print job, the controller 110 causes the developing power supplies 11Y, 11C, 11M, and 11K to output the developing biases Vb based on the developing bias reference value stored, for each of yellow, cyan, magenta, and black, in the nonvolatile memory. In addition, the controller 110 causes the charging power supplies 12Y, 12C, 12M, and 12K to output the charging bias Vd based on the charging bias reference value stored in the nonvolatile memory and causes the laser writing device 21 to output the LD power.

The controller 110 performs the above-described process control to determine the developing bias reference value, the charging bias reference value, and the optical writing intensity (or LD power to be described later) to attain the target toner adhesion amount, thereby stabilizing the image density of the whole image regarding each of yellow, cyan, magenta, and black for a long period. However, it is possible that, as the development gap between the photoconductor 20 (20Y, 20C, 20M, or 20K) and the developing sleeve 81 (81Y, 81C, 81M, or 81K) fluctuates (hereinafter "gap fluctuation"), image density fluctuates cyclically in one page.

In the image density fluctuation, image density fluctuation occurring with the rotation cycle of the photoconductors 20Y, 20C, 20M, and 20K and image density fluctuation occurring with the rotation cycle of the developing sleeves 81Y, 81C, 81M, and 81K are superimposed. Specifically, if the rotation axis of the photoconductor 20 (20Y, 20C, 20M, or 20K) is eccentric, the eccentricity causes gap fluctuations drawing a variation curve shaped like a sine curve per photoconductor rotation. As a result, in the developing electrical field generated between the photoconductor 20 (20Y, 20C, 20M, or 20K) and the developing sleeve 81 (81Y, 81C, 81M, and 81K), the strength of the field fluctuates, drawing a variation curve shaped like a sine curve for each round of the photoconductor 20. Fluctuations in electrical field strength cause the image density fluctuation that draws a sine curve per photoconductor rotation cycle. Further, the external shape of the photoconductor tends to have distortion. The distortion results in cyclic gap fluctuation drawing same patterns per photoconductor rotation, which cause image density fluctuation. Further, eccentricity or distortion of the external shape of the developing sleeve 81 (81Y, 81C, 81M, or 81K) causes gap fluctuation in the cycle of rotation of the developing sleeve 81 (hereinafter "sleeve rotation cycle") and results in cyclic image density fluctuation. In particular, since the image density fluctuation due to the eccentricity or distortion in the shape of the developing sleeve 81, which is smaller in diameter than the photoconductors 20, occurs in relatively short cycle, such image density fluctuation is more noticeable.

In view of the foregoing, in performing print jobs, the controller 110 (e.g., an output change device) performs the following processing to change outputs for each of yellow, cyan, magenta, and black. Specifically, for each of yellow, cyan, magenta, and black, the controller 110 stores, in the nonvolatile memory, a modulation pattern of the developing bias to cause changes in the developing electrical field strength capable of offsetting the image density fluctuation occurring in the cycle of photoconductor rotation. The controller 110 further stores, in the nonvolatile memory, a modulation pattern of the developing bias to cause changes in the developing electrical field strength capable of offsetting the image density fluctuation occurring in sleeve rotation cycle. Hereinafter, the former modulation pattern is referred to as "developing-bias change pattern (developing change pattern) for photoconductor cycle." The latter modulation pattern is also referred to as "developing-bias change pattern (developing change pattern) for sleeve cycle."

The developing-bias change pattern for photoconductor cycle, which is generated individually for yellow, magenta, cyan, and black, is a pattern for one rotation cycle of the photoconductor 20, and the pattern is made with reference to the reference attitude timing of the photoconductor 20. The developing-bias change pattern is used to change the output of the developing bias from the developing power supplies (11Y, 11C, 11M, and 11K) based on the developing bias reference values for yellow, cyan, magenta, and black determined in the process control. For example, in the case of data table format, the developing-bias change pattern includes a group of data on differences in the output developing bias at predetermined intervals in a period equivalent to one rotation cycle starting from the reference attitude timing. Leading data in the data group represents the developing bias output difference at the reference attitude timing, and second data, third data, and fourth data to later data represent the developing bias output differences at the predetermined intervals subsequent to the reference attitude timing. For example, an output pattern formed of a group of data 0, −5, −7, −9, . . . represents that the developing bias output differences are 0 V, −5 V, −7 V, −9 V . . . at predetermined intervals, respectively. To simply suppress the image density fluctuation occurring in photoconductor rotation cycle, the developing bias output from the developing power supply 11 can be a value in which the developing bias reference value is superimposed with the developing bias output difference. In the copier 500 according to the present embodiment, however, to suppress the image density fluctuation in sleeve rotation cycle as well, the developing bias output difference to suppress the image density fluctuation in photoconductor rotation cycle and the developing bias output difference to suppress the image density fluctuation in sleeve rotation cycle are superimposed on the developing bias reference value.

The developing-bias change pattern for sleeve cycle, which is generated individually for yellow, magenta, cyan, and black, is a pattern for one rotation cycle of the developing sleeve 81, and the pattern is made with reference to the reference attitude timing of the developing sleeve 81. The developing-bias change pattern is used to change the output of the developing bias from the developing power supplies (11Y, 11C, 11M, and 11K) based on the developing bias reference values for yellow, cyan, magenta, and black determined in the process control (i.e., reference value determination process). In the case of data table format, leading data in the data group represents the developing bias output difference at the reference attitude timing, and second data, third data, and fourth data to later data represent the developing bias output differences at the predetermined intervals subsequent to the reference attitude timing. The predetermined intervals are identical to the intervals reflected in the data group in the developing-bias change pattern for photoconductor cycle.

In image forming operation, the controller 110 reads the data of developing-bias change pattern for photoconductor cycle, which individually corresponds to yellow, cyan, magenta, and black, at the predetermined intervals. Simultaneously, the controller 110 also reads the data of the developing-bias change patterns for sleeve cycle, which individually correspond to yellow, cyan, magenta, and black, at the identical predetermined intervals. In reading the data, in the case where the reference attitude timing does not arrive even after the last data of the data group is read, the controller 110 sets the read value identical to the last data until the reference attitude timing arrives. In the case where the reference attitude timing arrives before the last data of the data group is read, the data read position is returned to the initial data. Regarding the reading of data from the developing-bias change pattern for photoconductor cycle, a timing at which the photoconductor rotation sensor 76 transmits the reference attitude timing signal is used as the reference attitude timing. Regarding the reading of data from the developing-bias change pattern for sleeve cycle, a timing at which the sleeve rotation sensor 83 transmits the reference attitude timing signal is used as the reference attitude timing.

For each of yellow, cyan, magenta, and black, in such a data reading process, the data read from the developing-bias change pattern for photoconductor cycle and that from the developing-bias change pattern for sleeve cycle are added together to calculate the superimposed value. For example, when the data read from the developing-bias change pattern for photoconductor cycle indicates −5 V and the data read from the developing-bias change pattern for sleeve cycle indicates 2 V, −5 V and 2 V are added together. Then, the superimposed value is −3 V. When the developing bias reference value is −550 V, the result of addition of the superimposed value is −553 V, which is output from the developing power supply 11. Such processing is performed for each of yellow, cyan, magenta, and black at the predetermined intervals.

With this processing, the developing electrical field between the photoconductor 20 and the developing sleeve 81 is varied in strength to offset an electrical field strength variation that is a superimposition of two types of variations in the electrical field strength, namely, (i) electrical field strength variation caused by the gap fluctuation in photoconductor rotation cycle, due to eccentricity or distortion in the external shape of the photoconductor 20, and (ii) electrical field strength variation in sleeve rotation cycle due to eccentricity or distortion in the external shape of the developing sleeve 81. With such processing, regardless of the rotation attitude of the photoconductor 20 and that of the developing sleeve 81, the developing electrical field between the photoconductor 20 and the developing sleeve 81 can be kept substantially constant. This processing can suppress the image density fluctuation occurring in both of the photoconductor rotation cycle and the sleeve rotation cycle.

The developing-bias change pattern for photoconductor cycle and that for sleeve cycle, which individually corresponds to each of yellow, cyan, magenta, and black, are generated at predetermined timings. The predetermined timings includes a timing before a first print job and after shipping from factory (an initial startup), a replacement detection timing at which replacement of the image forming unit 18 is detected, and a timing of environmental change at which environmental change from previous generation processing of output pattern exceeds a threshold. At the initial startup and the timing of environmental change, the developing-bias change pattern for photoconductor cycle is generated for each of yellow, cyan, magenta, and black. Additionally, the developing-bias change pattern for sleeve cycle is generated. In contrast, in the replacement detection timing, only for the image forming unit 18, replacement of which is detected, the developing-bias change pattern for photoconductor cycle and the developing-bias change pattern for sleeve cycle are generated. To enable the generation of pattern data, as illustrated in FIGS. 7A and 7B, the copier 500 includes the unit mount sensors 17Y, 17C, 17M, and 17K to individually detect the replacement of the image forming units 18Y, 18C, 18M, and 18K.

The controller 110 according to the present embodiment uses the amount of change in absolute humidity as the environmental change. The controller 110 calculates the absolute humidity based on temperature detected by the environment sensor 124 and relative humidity detected by the environment sensor 124. The absolute humidity calculated in the previous generation processing of output pattern is stored. Subsequently, the controller 110 regularly calculates the absolute humidity based on the detection results on temperature and humidity, generated by the environment sensor 124. When the difference (environmental change amount) between the calculated value and the stored absolute humidity exceeds the threshold, the controller 110 generates (renews) the developing-bias change pattern.

Figure 12:
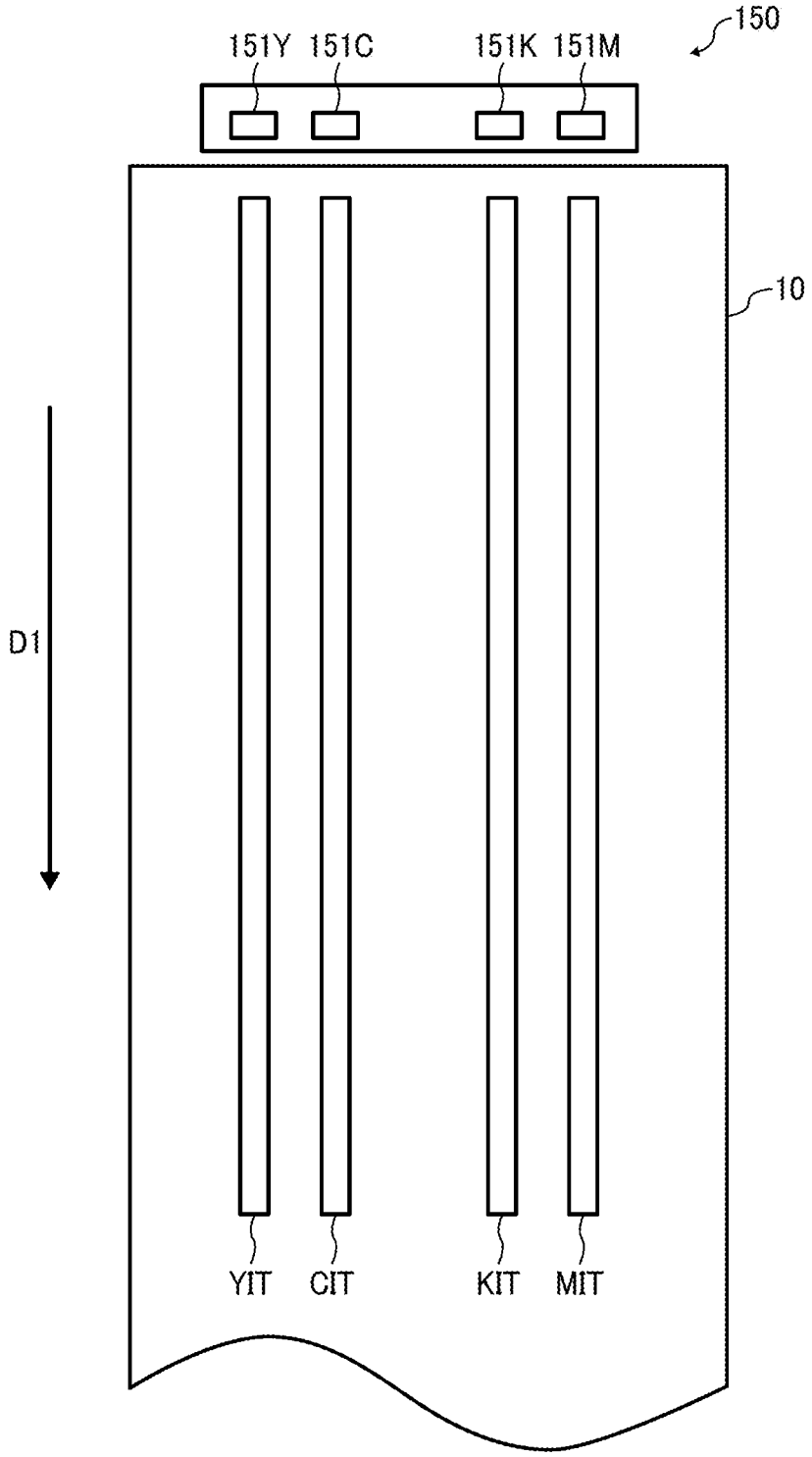
FIG. 12 is a schematic plan view of a first test image of each color on the intermediate transfer belt, according to an embodiment.

In the processing to generate the developing-bias change pattern at the initial startup timing, initially, a first test image for yellow, which is a solid toner image, is formed on the photoconductor 20Y. In addition, a first test image for cyan, a first test image for magenta, and a first test image for black, which are respectively cyan, magenta, and black solid toner images, are formed on the photoconductor 20C, the photoconductor 20M, and the photoconductor 20K. Then, first test images YIT, CIT, MIT, and KIT are primarily transferred onto the intermediate transfer belt 10, as illustrated in FIG. 12. In FIG. 12, since the first test image YIT is used to detect the yellow image density fluctuation in the rotation cycle of the photoconductor 20Y, the first test image YIT is longer than the length of circumference (in the direction of arc) of the photoconductor 20Y in the belt travel direction indicated by arrow D1 in FIG. 12. Likewise, the first test images CIT. MIT, and KIT for cyan, magenta, and black are longer than the lengths of circumference of the photoconductors 20C, 20M, and 20K, respectively.

In FIG. 12, for convenience, the four test toner images (YIT, CIT, MIT, and KIT) for the density unevenness detection are lined in the belt width direction. In practice, however, there are cases where the positions of the first test images of different colors on the belt may be shifted from each other, at most, by an amount equivalent to the length of circumference of the photoconductor 20. This is because, for each color, formation of the first test image is started to match a leading end position of the first test image with a reference position on the photoconductor 20 (photoconductor surface position entering the developing range at the reference attitude timing) in the direction of circumference of the photoconductor 20. That is, the first test image for each color is formed such that the leading end thereof matches the reference position of the photoconductor 20 in the direction of circumference.

Instead of a solid toner image, a halftone toner image may be formed as the first test image. For example, a halftone toner image having a dot coverage of 70% can be formed.

The controller 110 executes the processing to generate the developing-bias change pattern and the process control together as a set. Specifically, immediately before generating the developing-bias change patterns, the controller 110 executes the process control to determine the developing bias reference value for each color. Then, in the processing to generate the developing-bias change pattern executed immediately after the process control, the controller 110 develops, for each color, the first test image with the developing bias reference value determined by the process control. Accordingly, logically, the first test image is developed to have the target toner adhesion amount. However, actually, minute density unevenness occurs due to the gap fluctuation.

The time lag between the start of formation of the first test image (writing of the electrostatic latent image) and the arrival of the leading end of the first test image at a detection position by the reflective photosensor of the optical sensor unit 150 is different among the four colors. However, in the case of the same color, the time lag between writing and detection is constant over time, which is hereinafter referred to as "writing-detection time lag."

The controller 110 preliminarily stores the writing-detection time lag, for each color, in the nonvolatile memory. For each color, sampling of output from the reflective photosensor starts after the writing-detection time lag has passed from the start of formation of the first test image. This sampling is repeated at predetermined intervals throughout one rotation cycle of the photoconductor 20. The interval is identical to the interval of reading of each data in the output pattern used to change the output of developing bias. The controller 110 generates, for each color, a density unevenness graph indicating the relation between the toner adhesion amount (image density) and time (photoconductor surface position), based on the sampling data. From the density unevenness graph, the controller 110 extracts two fluctuation patterns of solid image density: (1) the fluctuation pattern of solid image density occurring in photoconductor rotation cycle, and (2) the fluctuation pattern of solid image density occurring in sleeve rotation cycle.

After extracting the fluctuation pattern of solid image density in photoconductor rotation cycle based on the sampled data for each color, the controller 110 calculates an average toner adhesion amount (average image density). In this average toner adhesion amount, an average of fluctuations in the development gap in one rotation of the photoconductor 20 is almost reflected. Therefore, with respect to the average toner adhesion amount, the controller 110 generates the developing-bias change pattern for photoconductor cycle to offset the fluctuation pattern of solid image density in photoconductor rotation cycle.

Specifically, the controller 110 calculates the bias output differences individually corresponding to a plurality of data values of toner adhesion amount included in the solid image density pattern. The bias output differences are based on the average toner adhesion amount. The bias output difference corresponding to the toner adhesion amount data identical in value to the average toner adhesion amount is calculated as zero.

The bias output difference corresponding to the toner adhesion amount data larger in value than the average toner adhesion amount is calculated as a positive value corresponding to the difference between that toner adhesion amount and the average toner adhesion amount. Being a plus value, this bias output difference changes the developing bias, which is negative in polarity, to a value lower (smaller in absolute value) than the developing bias reference value.

In addition, the bias output difference corresponding to the toner adhesion amount data smaller in value than the average toner adhesion amount is calculated as a negative value corresponding to the difference between that toner adhesion amount and the average toner adhesion amount. Being a minus value, this bias output difference changes the developing bias, which is negative in polarity, to a value higher (larger in absolute value) than the developing bias reference value.

Thus, the controller 110 obtains the bias output difference corresponding to each toner adhesion amount data and generates the developing-bias change pattern for photoconductor cycle, in which the obtained bias output differences are arranged in order.

In addition, after extracting, for each color, the fluctuation pattern of solid image density in sleeve rotation cycle based on the sampling data, the controller 110 calculates an average toner adhesion amount (average image density). In this average toner adhesion amount, an average of fluctuations in the development gap in one rotation of the developing sleeve 81 is almost reflected. Therefore, with respect to the average toner adhesion amount, the controller 110 generates the developing-bias change pattern for sleeve cycle to offset the fluctuation pattern of solid image density in sleeve rotation cycle. The developing-bias change pattern for sleeve cycle can be generated through processing similar to the processing to generate the developing-bias change pattern for photoconductor cycle to offset the solid image density fluctuation in photoconductor rotation cycle.

Figure 13:
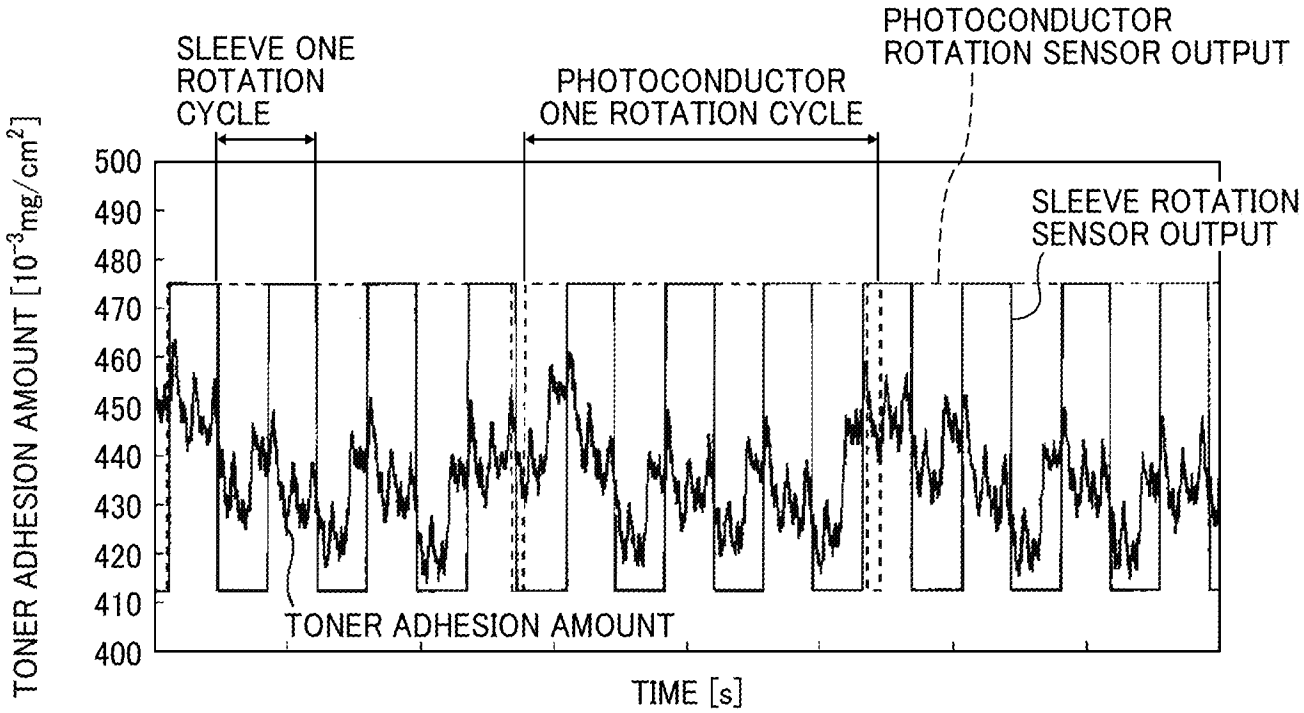
FIG. 13 is a graph illustrating a relation between cyclic fluctuations in the toner adhesion amount of the first test image, output from a sleeve rotation sensor, and output from the photoconductor rotation sensor.

FIG. 13 is a chart illustrating a relation among the cyclic fluctuations in toner adhesion amount of the first test image, the output from the sleeve rotation sensor 83, and the output from the photoconductor rotation sensor 76. The vertical axis of the graph represents the toner adhesion amount in $10^3$ mg/cm$^2$, which is obtained by converting the output voltage from the reflective photosensor 151 of the optical sensor unit 150 according to a predetermined conversion formula. From FIG. 13, it is understood that the image density of the first test image exhibits cyclic fluctuation pattern in the travel direction of the intermediate transfer belt 10.

Figure 14:
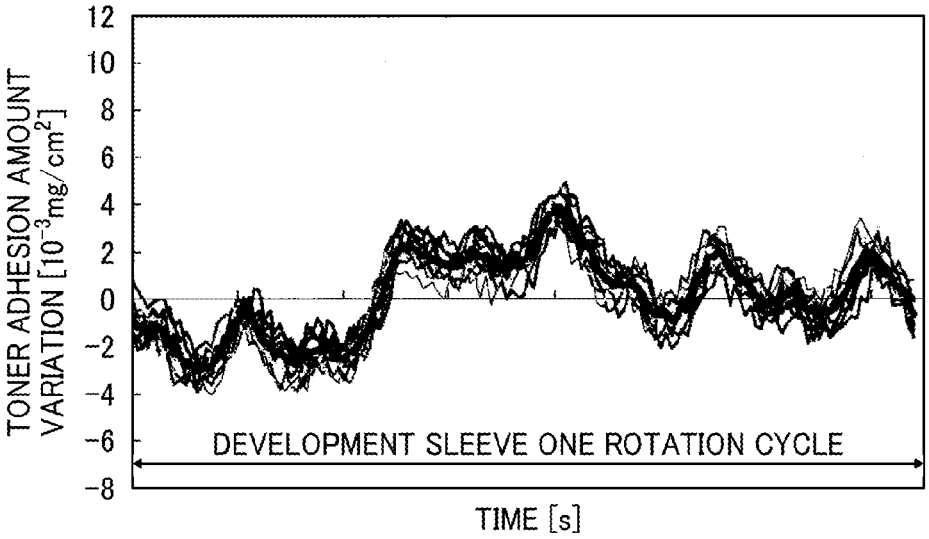
FIG. 14 is a graph illustrating an average waveform.

In generating the developing-bias change pattern (developing change pattern) for sleeve cycle, initially, in order to remove the cyclic fluctuation components different from those of sleeve cycle, the controller 110 takes out data on fluctuation with time of toner adhesion amount per sleeve rotation cycle and performs averaging. Specifically, the length of the first test image is at least ten times longer than the length of circumference of the developing sleeve 81. Accordingly, the data on fluctuation with time of toner adhesion amount is obtained for a period equivalent to ten times or more of sleeve rotation cycle. Based on this data, a fluctuation waveform starting from the sleeve reference attitude timing is cut out for each sleeve rotation cycle. Thus, ten fluctuation waveforms are cutout. Subsequently, as illustrated in FIG. 14, the cutout waveforms are superimposed, with the sleeve reference attitude timings thereof synchronized, and averaging is executed. Then, the average waveform is analyzed. The average waveform obtained by averaging the ten cutout waveforms is indicated by a bold line in FIG. 14. The individual cutout waveforms include cyclic fluctuation components deviating from those in the sleeve rotation cycle and are not smooth. In the average waveform, deviation is reduced. Although averaging is performed as to ten cutout waveforms in the copier 500 according to the present embodiment, a different method may be used as long as fluctuation components in the sleeve rotation cycle can be extracted.

In the copier 500 according to the present embodiment, similarly to the developing-bias change pattern for sleeve cycle, the developing-bias change pattern (developing change pattern) for photoconductor cycle is generated based on the result of averaging of the waveforms cutout per photoconductor rotation cycle. To generate the developing-bias change pattern based on the average waveform, the toner adhesion amounts are converted into developing-bias change amounts using, for example, an algorithm illustrated in FIG. 15.

Figure 15:
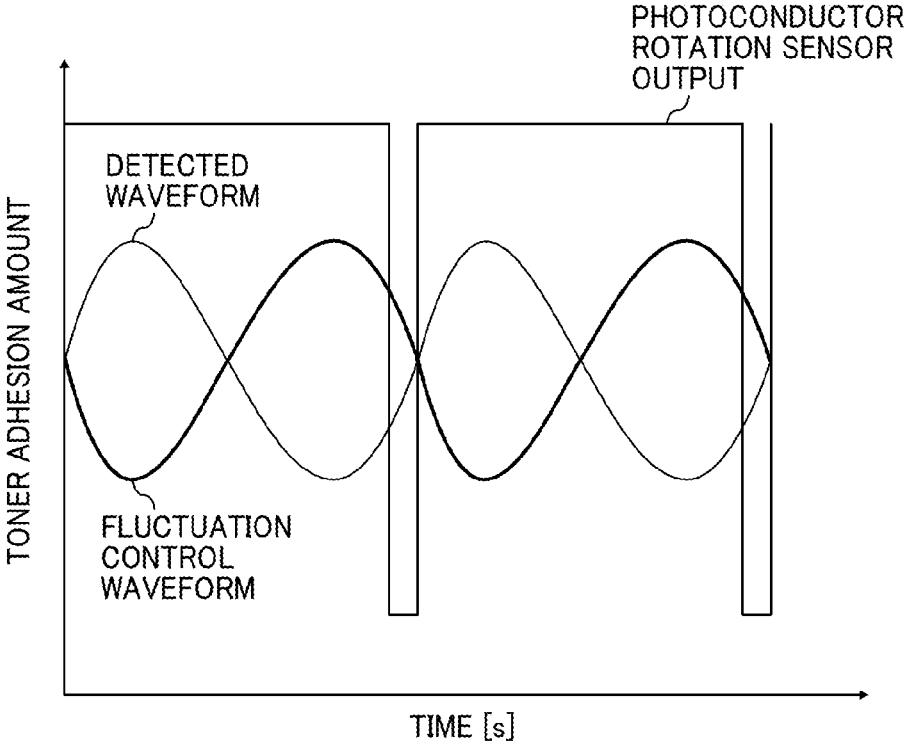
FIG. 15 is a graph for a principle of algorithm used in generating developing-bias change pattern, according to an embodiment.

The algorithm illustrated in FIG. 15 can generate a developing-bias change to draw a fluctuation control waveform having a phase reverse to the phase of the waveform of the detected toner adhesion amount fluctuation.

Figure 16:
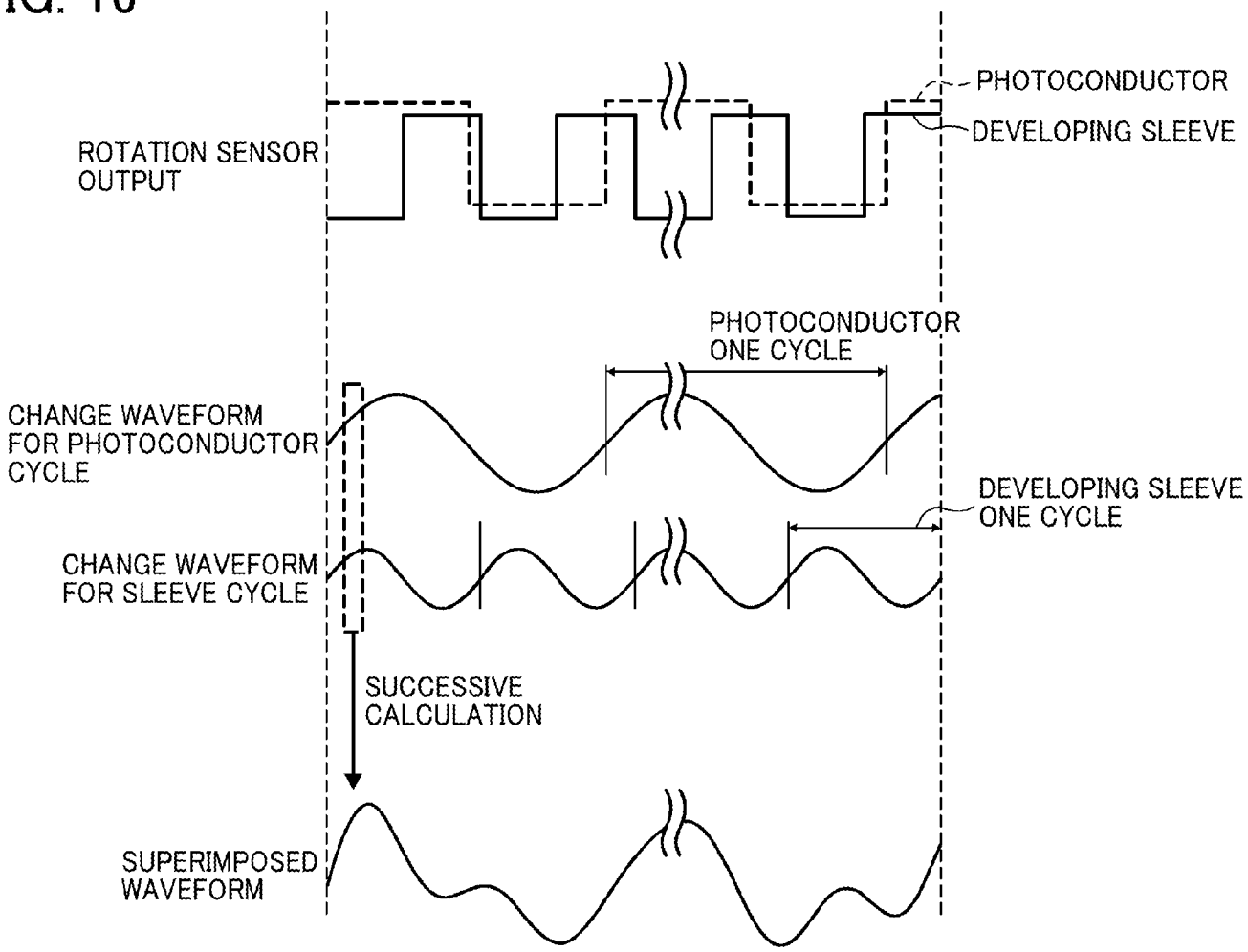
FIG. 16 is a timing chart illustrating each output timing in image formation, according to an embodiment.

As described above, for each color, the output of developing bias Vb from the developing power supply (11Y, 11C, 11M, or 11K) is changed, using the developing-bias change pattern for photoconductor cycle and the developing-bias change pattern for sleeve cycle generated in the generation processing. More specifically, as illustrated in FIG. 16, the developing bias is cyclically changed in accordance with the superimposed waveform in which the change waveform based on the developing-bias change pattern for photoconductor rotation cycle and the change waveform based on the developing-bias change pattern for sleeve cycle are superimposed. As a result, the image density fluctuation occurring in the photoconductor rotation cycle or that occurring in the sleeve rotation cycle can be suppressed.

In an image including a solid portion and a halftone portion, the image density of the solid portion is greatly affected by the developing potential. The developing potential is the difference between the developing bias Vb and the latent image potential VI (the potential of the electrostatic latent image). By contrast, the image density of the halftone portion may be affected more by the background potential being the difference between the background potential Vd of the photoconductor and the developing bias Vb from the following reason. Specifically, in the solid portion, the periphery of each dot is overlapped with the peripheries of adjacent dots. That is, there are no isolated dots. By contrast, the halftone portion includes isolated dots or a small group of dots. The isolated dot or the small group of dots is affected more by an edge effect than the solid portion is. Accordingly, when the background potential is identical between the solid portion and the halftone portion, the force of adhesion to the photoconductor is stronger in the halftone portion than in the solid portion, and the halftone portion is less affected by the gap fluctuation. Further, the toner adhesion amount per unit area is greater in the halftone portion than in the solid portion. Accordingly, fluctuations in the toner adhesion amount caused by the gap fluctuation are smaller in the halftone portion than in the solid portion. When the developing bias Vb is changed using the superimposed output pattern according to the first test image that is a solid toner image, the image density fluctuation in the solid portion can be suppressed. In the halftone portion, however, overcorrection occurs. The overcorrection results in the image density fluctuation in the halftone portion.

Since the edge effect is heavily affected by the background potential, the background potential can be adjusted to adjust the above-described overcorrection. For that, the background potential Vd can be changed by changes of the charging bias. Even when the background potential Vd is thus changed, the developing potential can be kept substantially constant. For example, it is assumed that, under conditions of a normal background potential Vd of −1100 V, a developing bias Vb of −700 V, and a latent image potential VI of −50 V, the background potential Vd is changed to −1000 V or -1200 V as required. Even if the background potential is thus changed, as long as the latent-image writing intensity is set to a value capable of attaining a saturated exposure potential of about −50 V, the latent image potential VI can be kept at approximately −50 V regardless of the background potential Vd. Accordingly, even when the background potential is changed by the change of the background potential Vd, the developing potential Vp can be kept constant, and the image density of the solid portion is not affected.

Therefore, in the above-described generation processing, the controller 110 generates, for each of yellow, cyan, magenta, and black, a charging-bias change pattern (i.e., charging change pattern) for photoconductor cycle and a charging change pattern for sleeve cycle in addition to the developing-bias change patterns (developing change patterns) for photoconductor cycle and sleeve cycle. Specifically, after generating the developing-bias change pattern, a second test image for yellow, which is a yellow halftone toner image, is formed on the photoconductor 20Y. In addition, a second test image for cyan, a second test image for magenta, and a second test image for black, which are respectively cyan, magenta, and black halftone toner images, are formed on the photoconductor 20C, the photoconductor 20M, and the photoconductor 20K. In forming the second test images, the developing bias Vb is changed based on the developing bias reference value, the developing-bias change pattern for photoconductor cycle, the photoconductor reference attitude timing, the developing-bias change pattern for sleeve cycle, and the sleeve reference attitude timing. Such conditions inhibit the image density of the solid portion from fluctuating corresponding to the photoconductor rotation cycle and the sleeve rotation cycle. However, the four second test images, which are halftone toner images, cause overcorrection of the developing bias Vb, making the image density uneven. To detect the image density fluctuation, the controller 110 samples the outputs from the four reflective photosensors 151 of the optical sensor unit 150 at predetermined intervals for a period equal to or longer than one rotation cycle of the photoconductor 20.

Subsequently, the controller 110 extracts a pattern of density fluctuation occurring in the photoconductor rotation cycle, based on the sampled data obtained for each color. The controller 110 calculates an average toner adhesion amount (or an average image density) of the second test image based on the density fluctuation pattern. Thereafter, regarding the halftone portion, the controller 110 generates the charging-bias change pattern with respect to the average toner adhesion amount thus obtained so as to offset the pattern of image density fluctuation in the photoconductor rotation cycle. Specifically, the controller 110 calculates the bias output differences individually corresponding to a plurality of data values of toner adhesion amount included in the image density fluctuation pattern. The bias output differences are based on the average toner adhesion amount. The bias output difference corresponding to the toner adhesion amount data identical in value to the average toner adhesion amount is calculated as zero. The bias output difference corresponding to the toner adhesion amount data larger in value than the average toner adhesion amount is calculated as a positive value corresponding to the difference between that toner adhesion amount and the average toner adhesion amount. Being a plus value, this bias output difference changes the developing bias, which is negative in polarity, to a value lower (smaller in absolute value) than the developing bias reference value. In addition, the bias output difference corresponding to the toner adhesion amount data smaller in value than the average toner adhesion amount is calculated as a negative value corresponding to the difference between that toner adhesion amount and the average toner adhesion amount. Being a minus value, this bias output difference changes the developing bias, which is negative in polarity, to a value higher (larger in absolute value) than the developing bias reference value.

Thus, the controller 110 obtains the bias output differences individually corresponding to the plurality of data values of toner adhesion amount and generates the charging-bias change pattern for photoconductor cycle, in which the obtained bias output differences are arranged in order.

Next, after extracting the pattern of image density fluctuation in the sleeve rotation cycle based on the sampled data for each color, the controller 110 calculates an average toner adhesion amount (average image density). With respect to the average toner adhesion amount, the controller 110 generates the charging-bias change pattern (charging change pattern) for sleeve cycle to offset the density fluctuation pattern in the sleeve rotation cycle. The controller 110 generates the charging-bias change pattern through processing similar to the processing to generate the charging-bias change pattern for the photoconductor cycle.

After generating the data of charging-bias change pattern, ordinal numbers of individual data values in the output pattern are shifted by a predetermined number. Specifically, the leading data value in the developing-bias change pattern for photoconductor cycle corresponds to, of an entire surface of the photoconductor 20, a photoconductor surface position entering the developing range when the photoconductor 20 takes the reference rotation position. The position is charged in not the developing range but the area of contact between the charging roller 71 and the photoconductor 20. Since it takes time (i.e., time lag) for the photoconductor surface to move from the charging contact position to the developing range, the position of each data is shifted by a number corresponding to the time lag. For example, when the pattern data includes 250 data values, positions of the first to 230th data values are shifted by 20, and the 231st data value to the 250th data value are changed to the first to 20th data. Regarding the charging-bias change pattern for sleeve cycle, the positions of the data values are similarly shifted by a predetermined number.

In image formation according to a command from a user, the output of the developing bias Vb from the developing power supply 11 is changed, for each color, according to the developing-bias change pattern for photoconductor cycle and the developing-bias change pattern for sleeve cycle generated as described above. Specifically, according to the developing-bias change pattern for photoconductor cycle, the photoconductor reference attitude timing, the developing-bias change pattern for sleeve cycle, and the sleeve reference attitude timing, the superimposed output pattern (data to reproduce the superimposed waveform) is generated. Then, based on the superimposed output pattern and the developing bias reference value, the output value of the developing bias Vb is changed. This processing can suppress the image density fluctuation of the solid image portion occurring in the photoconductor rotation cycle and the sleeve rotation cycle.

In parallel to changing the developing bias as described above, the output of the charging bias (i.e., charging power) from the charging power supply 12 is changed based on the charging-bias change pattern for photoconductor cycle and that for sleeve cycle.

Specifically, according to the charging-bias change pattern for photoconductor cycle, the photoconductor reference attitude timing, the charging-bias change pattern for sleeve cycle, and the sleeve reference attitude timing, the superimposed output pattern is generated. Then, the output value of the charging bias from the charging power supply 12 is changed based on the superimposed output pattern and the charging bias reference value, which has been determined in the process control. This processing can suppress the image density fluctuation of the halftone image portion in the photoconductor rotation cycle or the sleeve rotation cycle due to the overcorrection of the developing bias Vb.

Figure 17:
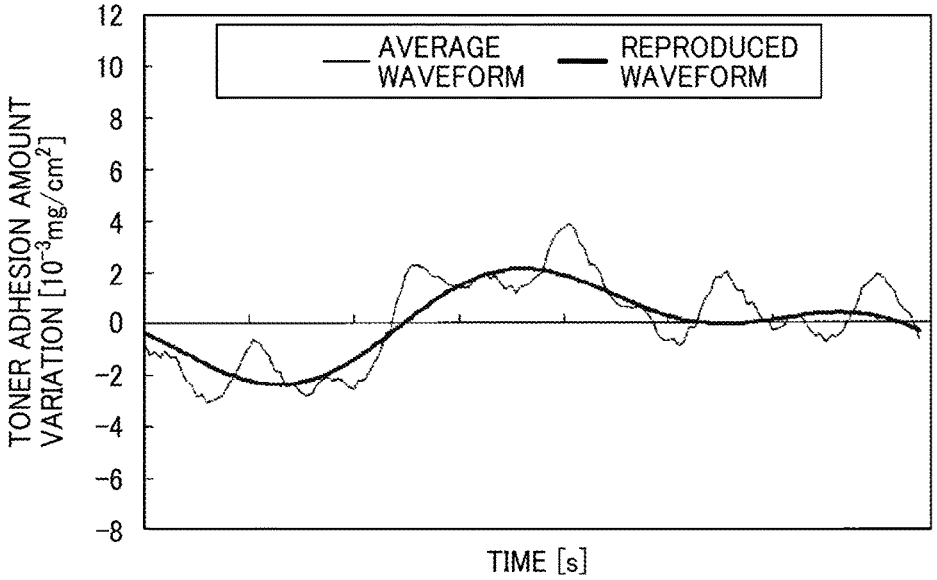
FIG. 17 is a graph illustrating changes with time in the toner adhesion amount in an average waveform cut out with a sleeve rotation cycle and those in a waveform converted for reproduction.

FIG. 17 is a graph illustrating changes with time of toner adhesion amount in an average waveform of waveforms cutout per sleeve rotation cycle and a reproduced waveform converted for reproduction. In FIG. 17, the average waveform is obtained by averaging ten cutout waveforms cut out from the data of density fluctuation pattern in the sleeve rotation cycle to generate the developing-bias change pattern for sleeve cycle. The average waveform is almost completely reproduced by superimposing, multiple times, a sine wave having a cycle twenty times as long as the sleeve rotation cycle. However, as the frequency of bias change becomes higher, follow-up performance of the image density fluctuation inherent to the change in the developing bias deteriorates, from the following reason.

The electrostatic latent image on the photoconductor 20 is developed when the electrostatic latent image is located within the developing range having the developing range length L illustrated in FIG. 6. In a period from when the electrostatic latent image enters the developing range to when the electrostatic latent image exits the developing range, even if the output value of the developing bias is finely changed, it is difficult to finely vary the amount of toner adhering (image density) to the electrostatic latent image following the change in the output value of the developing bias. An average bias value in the above-mentioned period greatly affects the image density of the electrostatic latent image, and instant bias changes do not much affect the image density. If the developing range length L is extremely shortened to avoid this phenomenon, the necessary developing power is not obtained. Thus, there is a limit on the frequency of cyclic fluctuation component of the image density that can be suppressed by changing the developing bias.

From this reason, in the copier 500 according to an embodiment, the upper limit of frequency of cyclic fluctuation component of the image density to be extracted, is set to three times as large as the sleeve rotation cycle. Specifically, a sine wave having a cycle three times as long as the sleeve rotation cycle is superimposed multiple times to reproduce the average waveform. The reproduced waveform illustrated in FIG. 16 is obtained by such reproduction. The controller 110 generates, based on the reproduced waveform, the developing-bias change pattern for photoconductor rotation cycle and the developing-bias change pattern for sleeve cycle, through the following method, for example. First, the controller 110 performs frequency analysis on the average waveform. The frequency analysis may be based on Fourier transformation (FFT) or alternatively, quadrature detection. In the present embodiment, quadrature detection is employed.

The average waveform illustrated in FIG. 17 is represented by superimposition of sine wave cyclically varying at a frequency being an integral multiple of the sleeve rotation cycle, as expressed in the following formula $$f(t)=A1\times\sin(\omega t+\theta 1)+A2\times\sin(2\times\omega t+\theta 2)+A3\times\sin(3\times\omega t+\theta 3)+\ldots+Ax\times\sin(x\times\omega t+\theta x)$$

where x is an upper limit of the frequency of variation of the sine wave. The above formula can be transformed into the formula below.

$$f(t)=\Sigma A_i\times\sin(i\times\omega t+\theta_i)$$

where i is a natural number from 1 to x.

The reference characters represent parameters as follows.

f(t): Average waveform of cutout waveforms of fluctuations in toner adhesion amount [$10^3$ mg/cm$^2$];

$A_i$: Amplitude of sine wave [$10^{-3}$ mg/cm$^2$];

ω: Angular speed of the sleeve or the photoconductor [rad/s];

$\theta_i$: Phase of the sine wave [rad]; and t: Time [s]

In the present embodiment, $A_i$ and $\theta_i$ are calculated through quadrature detection, and the density fluctuation component per frequency is calculated. Then, the controller 110 generates the reproduced waveform to generate the developing-bias change pattern for sleeve cycle and the reproduced waveform to generate the developing-bias change pattern for photoconductor cycle, based on the following formula:

$$f_{1/2}(t)=\Sigma A_i\times\sin(i\times\omega t+\theta_i)$$

where i is from 1 to 3, and "i=1" means one rotation cycle of the sleeve or the photoconductor.

The charging-bias change pattern is generated similarly to the above-described generation of the developing-bias output. To generate the developing-bias change pattern or the charging-bias change pattern to inhibit the image density fluctuation in the photoconductor rotation cycle, the pattern of image density fluctuation is analyzed considering the reference attitude timing as follows. That is, the controller 110 considers the reference attitude timing of the photoconductor 20 in forming the first test image and the second test image and further considers the reference attitude timing of the photoconductor 20 in detecting the toner adhesion amounts of the test images. Additionally, to generate the developing-bias change pattern or the charging-bias change pattern to inhibit the image density fluctuation in the sleeve rotation cycle, the pattern of image density fluctuation is analyzed considering the reference attitude timing as follows. That is, the controller 110 considers the reference attitude timing of the developing sleeve 81 in forming the first test image and the second test image and further considers the reference attitude timing of the developing sleeve 81 in detecting the toner adhesion amounts of the test images.

Figure 18:
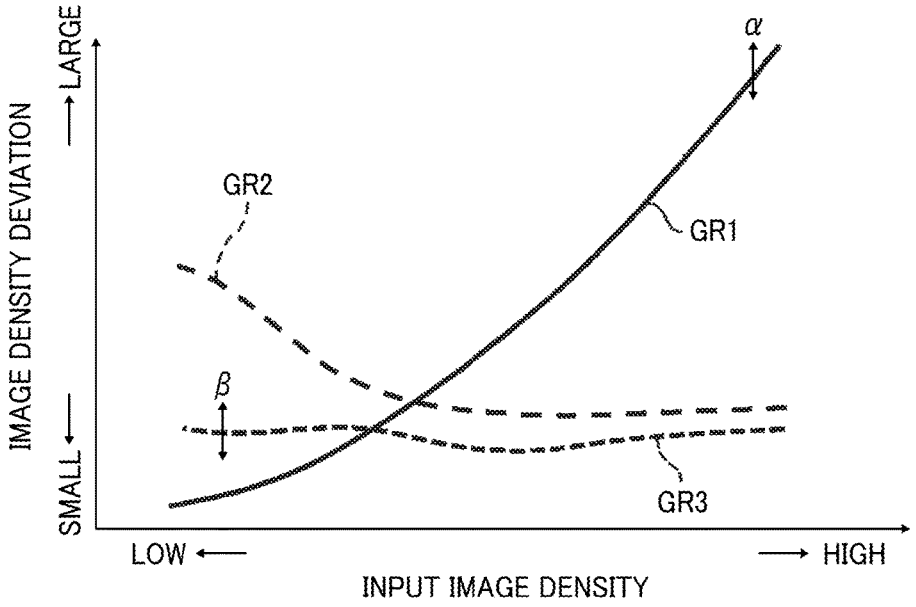
FIG. 18 is a graph illustrating relations between target image density of an output image and image density deviation, which is a deviation from the target image density.

FIG. 18 is a graph illustrating relations between the target image density (i.e., input image density) of an output image and image density deviation, which is a deviation from the target image density. In FIG. 18, Graph GR1 represents the image density deviation in a case where the above-described processing to change bias outputs is not performed (each of the developing bias and the charging bias is set at a constant value). In this case, as indicated by Graph GR1 (solid line), the image density deviation increases as the input image density increases. In other words, when the bias outputs are not changed, the image density unevenness is more noticeable in a high density portion than in a low density portion.

It is assumed that a developing-bias change pattern according to characteristics of Graph GR1 in FIG. 18 (bias outputs are not changed) is generated, the developing bias is cyclically changed based on the generated developing-bias change pattern, and the charging bias and the LD power are not cyclically changed but kept at constant values. In an image output under such conditions, the image density deviation exhibits the characteristics indicated by Graph GR2 (only the developing bias is changed) indicated by broken lines in FIG. 18. That is, while the image density deviation is not large in a moderate density portion and the high density portion, the image density deviation is large in the low density portion.

Therefore, as described above, the charging-bias change pattern is generated. Specifically, the second test image, which is a halftone toner image, is formed under such conditions that the developing bias is cyclically changed based on the developing-bias change pattern and the charging bias and the LD power are not cyclically changed but kept at constant values. Then, the charging-bias change pattern is generated based on the density fluctuation pattern of the second test image. While cyclically changing the developing bias based on the developing-bias change pattern, the controller 110 cyclically changes the charging bias based on the charging-bias change pattern generated above, thereby generating characteristics of image density deviation represented by Graph GR3 (developing bias and changing bias are changed) indicated by dotted line illustrated in FIG. 18. In other words, regardless of input image density, the image density deviation can be suppressed.

The controller 110 stores, as the developing-bias change pattern, a formula: $\Sigma Vb_i \times \sin(i \times \omega t + \theta_i)$ in which an amplitude $Vb_i$ calculated based on the amplitude $A_i$ of sine wave regarding the solid image density fluctuation is substituted, in the nonvolatile memory. This formula is hereinafter referred to as "developing-bias change pattern formula." In a print job, based on the developing-bias change pattern formula, the developing bias $Vb_i$ is calculated for each substitution of i (i=1 to x). The controller 110 normalizes the results of such calculation with the developing bias reference value obtained in the process control, to generate a group of data (a set of data of correction amount from the reference value). The developing bias Vb is cyclically changed based on the group of data, which is hereinafter referred to as "group of normalized data of developing-bias change pattern." The controller 110 stores, as the charging-bias change pattern, the formula: $\Sigma Vc_i \times \sin(i \times \omega t + \theta_i)$ in which an amplitude $Vc_i$ calculated based on the amplitude $A_i$ of sine wave regarding the halftone image density fluctuation is assigned, in the nonvolatile memory. This formula is hereinafter referred to as "charging-bias change pattern formula." In a print job, based on the charging-bias change pattern formula, the charging bias $Vc_i$ is calculated for each substitution of i (i=1 to x). The controller 110 normalizes the results of such calculation with the charging bias reference value obtained in the process control, to generate a group of data. The charging bias Vc is cyclically changed based on the group of data, which is hereinafter referred to as "group of normalized data of charging-bias change pattern." In processing a print job, the group of normalized data is generated based on the developing-bias change pattern formula and the charging-bias change pattern formula so that the data corresponds to the linear speed in the print job.

Even in an identical image forming apparatus, the characteristics represented by Graph GR1 in FIG. 18 varies as indicated by arrow a when the image forming unit 18 is replaced or the amount of environment change exceeds the threshold from the previous generation of bias change patterns. The characteristics of image density deviation of output images varies as indicated by arrow β if the bias change patterns are not renewed in response to such a change but the biases are output according to the previous developing-bias change pattern and the previous charging-bias change pattern. Then, there is a risk that the image density deviation exceeds an allowable range. In view of the foregoing, as described above, the controller 110 is configured to renew the bias change patterns when the image forming unit 18 is replaced or the amount of environment change exceeds the threshold from the previous generation of bias change patterns.

Next, a description will be given of a distinctive feature of the copier 500.

According to an experiment performed by the inventors, even if the output of the charging bias is cyclically changed based on the charging-bias change pattern, image density may cyclically fluctuate. Such cyclic density fluctuation is hereinafter called as "residual cyclic fluctuation."

According to the study on the residual cyclic fluctuation, made by the inventors, cyclically changing the charging bias based on the charging-bias change pattern causes the residual cyclic fluctuation.

Figure 19:
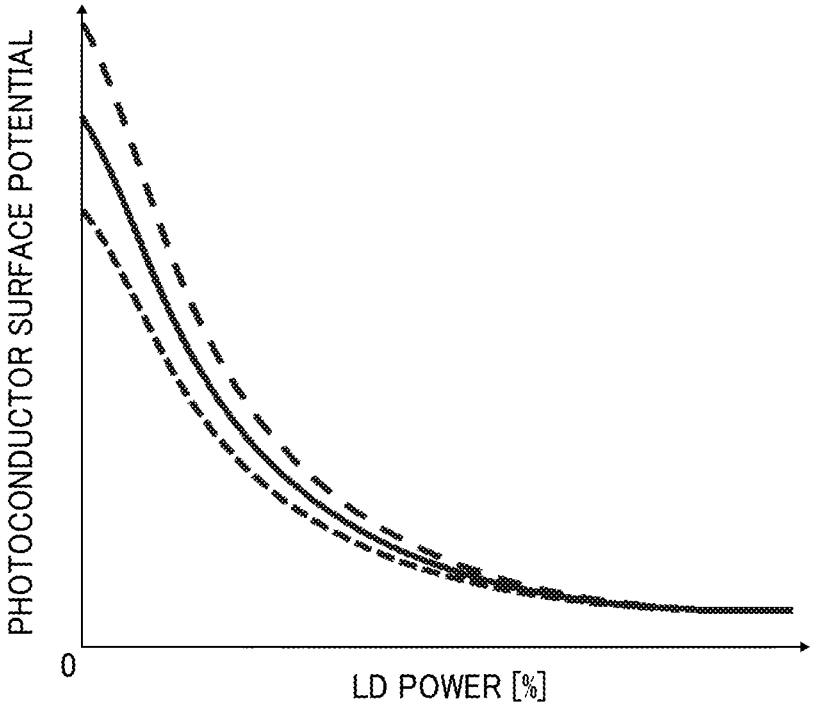
FIG. 19 is a graph illustrating relations among background potential (by uniform charging), latent image potential attained by optical writing, and LD power (percentage) in the optical writing.

FIG. 19 is a graph illustrating relations among the background potential (potential of a background portion uniformly charged by the charging device 70, out of the entire area of the photoconductor 20), the latent image potential attained by optical writing on the background portion, and the LD power (%) in the optical writing. In FIG. 19, the background potential is the surface potential of the photoconductor 20 corresponding to an LD power of 0%, and the latent image potential corresponds to an LD power greater than 0%. As optical writing is made on the background portion, the surface potential of the photoconductor 20 is attenuated according to the LD power, and the attenuated range becomes an electrostatic latent image. At that time, the characteristics of optical attenuation (photo-induced discharge) varies according to the potential of the background area of the photoconductor 20 (LD power is 0%), as illustrated in FIG. 19. Meanwhile, changing the developing bias does not vary the background potential of the photoconductor 20. Therefore, even when the developing bias is cyclically changed based on the developing-bias change pattern, the background potential of the photoconductor 20 is not affected.

However, the background potential of the photoconductor 20 fluctuates cyclically as the charging bias is cyclically changed based on the charging-bias change pattern. The cyclic fluctuations cause cyclic fluctuations in the latent image potential on the photoconductor 20. The image density fluctuations caused by the cyclic fluctuations in the latent image potential are the above-mentioned residual cyclic fluctuation resulting from the cyclic changes in the charging bias.

In FIG. 18, in accordance with the width of change of Graph GR1 (developing bias and the charging bias are not cyclically changed) representing the relation between the image density deviation and the input image density, the width of residual cyclic fluctuation (indicated by arrow β) changes. When the width of residual cyclic fluctuation grows by a certain degree, image density unevenness is recognized with eyes. To restrict the width of residual cyclic fluctuation to a certain amount, in the formula for obtaining LD power $LD_i'$ to be described later, for the amount by which the charging bias $Vc_i$ exceeds a threshold voltage $V_{max}$, the following value is added to the LD power $Ld_i$. That is, what added is the value corresponding to the difference between the threshold voltage $V_{max}$ and the charging bias $Vc_i$, which will be described in detail later.

After generating the developing-bias change pattern and the charging-bias change pattern in the above-described processing, the controller 110 generates a latent image change pattern to change the writing light amount (LD power or power of latent image writing) for suppressing the residual cyclic fluctuation in the image density. Specifically, while cyclically changing the developing bias and the charging bias respectively based on the developing-bias change pattern and the charging-bias change pattern, the controller 110 causes the image forming unit 18 to form a third test image (i.e., test toner image for pattern generation), which is a halftone toner image. Then, based on the detected toner adhesion amount of the third test image, the controller 110 generates the writing change pattern to cyclically change the LD power to suppress the residual cyclic fluctuation. As the writing change pattern, the controller 110 stores, in the nonvolatile memory, a formula: $\Sigma Ld_i' \times \sin(i \times \omega t + \theta_i)$ in which an amplitude $LD_i'$ calculated based on the amplitude $A_i$ of sine wave regarding the halftone image density fluctuation is substituted. This formula is hereinafter referred to as "writing change pattern formula." In a print job, based on the writing change pattern formula, the LD power $Ld_i'$ is calculated for each substitution of i (i=1 to x). The controller 110 normalizes the results of such calculation with a predetermined reference value to generate a group of data. The LD power is cyclically changed based on the group of data, which is hereinafter referred to as "group of normalized data of writing change pattern." Specifically, in the processing to change the LD power, the LD power is cyclically changed based on the writing change pattern, in addition to cyclically changing the developing bias and the charging bias respectively based on the developing-bias change pattern and the charging-bias change pattern. According to an experiment performed by the inventors, cyclically changing the LD power is effective in suppressing residual cyclic fluctuation in the image density.

The processing to generate the writing change pattern is described in detail below. Specifically, the developing bias Vb is cyclically changed based on the group of normalized data generated preliminarily based on the developing-bias change pattern. Then, the charging bias Vc is cyclically changed based on the group of normalized data generated preliminarily based on the charging-bias change pattern. The third test image, which is a halftone toner image, is formed while thus cyclically changing the developing bias Vb and the charging bias Vc. The controller 110 performs frequency analysis on the detection results of the image density fluctuation (residual cyclic fluctuation) of the third test image, thereby extracting the image density fluctuation pattern in the photoconductor rotation cycle and that in the sleeve rotation cycle from the detection result. The data of each of density fluctuation pattern is substituted by a predetermined conversion algorithm to generate tentative writing change patterns for the photoconductor rotation cycle and the sleeve rotation cycle. The predetermined conversion algorithm is based on an experiment performed under a predetermined charging bias and a predetermined LD power. The predetermined conversion algorithm is to convert each of a plurality of image density values included in the density fluctuation pattern, to a LD power value to attain a desirable image density. As the each of the image density values included in the density fluctuation pattern is converted based on the conversion algorithm to the LD power value, the tentative writing change pattern constituted of a plurality of LD power values is generated. The tentative writing change pattern is represented by a formula: $\Sigma Ld_i \times \sin(i \times \omega t + \theta_i)$ in which an amplitude $LD_i$ calculated based on the amplitude $A_i$ of sine wave regarding the halftone image density fluctuation is substituted.

When LD power $Ld_i$ obtained by the tentative writing change pattern is normalized with the predetermined reference value and the LD power is cyclically changed based on the group of normalized data, the residual cyclic fluctuation can be suppressed to a certain degree. However, the residual cyclic fluctuation is not efficiently removed because the charging bias adopted in the experiment (hereinafter "reference charging bias") to generate the above-mentioned conversion algorithm is different from the charging bias adopted in printing operation. The conversion algorithm is generated based on the experiment performed to study the relation between image density and LD power under a condition in which the photoconductor is charged with the reference charging bias. In printing, however, the charging bias is cyclically changed and is different from the reference charging bias in most of printing operation. As the difference between the charging bias and the reference charging bias increases, the density unevenness resulting from the difference becomes more noticeable (residual cyclic fluctuation is not fully removed). Accordingly, adjusting the output value of charging bias is preferable to restrict the increase of the difference.

Therefore, the controller 110 normalizes, with the predetermined reference value, each LD power $Ld_i$ obtained by the tentative writing change pattern formula for the photoconductor rotation cycle to construct a group of tentative LD power data. The controller 110 further constructs a group of normalized data based on the charging-bias change pattern. Similarly, regarding the sleeve rotation cycle, the controller 110 constructs a group of tentative LD power data and a group of normalized data based on the charging-bias change pattern. The LD power $Ld_i$ of each group of tentative LD power data is corrected with the following formula. When the charging bias $Vc_i$ is greater than the threshold voltage $V_{max}$, $$Ld_i'=Ld_i(1+\alpha(Vc_i-V_{max}))$$

where $Ld_i$ represents the LD power, $Ld_i'$ represents a corrected LD power, $\alpha$ represents a coefficient to adjust the magnitude of $Ld_i'$, and i is a number from 1 to x.

By contrast, when the charging bias $Vc_i$ is not greater than the threshold voltage $V_{max}$, $$Ld_i'=Ld_i.$$

With this configuration, of the LD power (amplitude) $Ld_i$ included in the tentative writing change pattern, only the LD power $Ld_i$ corresponding to the charging bias (amplitude) $Vc_i$ greater than the threshold voltage $V_{max}$ is corrected to a greater value. Thus, the controller 110 constructs a group of data constituted of the LD power data corrected as required. Based on the group of data, the controller 110 constructs a writing change pattern formula:

$$\Sigma Ld_i' \times \sin(i \times \omega t+\theta_i)$$

and stores the formula in the nonvolatile memory. When the tentative writing change pattern is corrected based on the charging-bias change pattern, the residual cyclic fluctuation is further suppressed. In a print job, based on the writing change pattern formula, the LD power $Ld_i'$ is calculated for each substitution of i (i=1 to x). The controller 110 normalizes the results of such calculation with the predetermined reference value to generate a group of data. The LD power Ld is cyclically changed based on the group of data (group of normalized data of writing change pattern). Note that, depending on the characteristics of optical attenuation of the photoconductor 20, instead of correcting the LD power $Ld_i$ corresponding to the charging bias $Vc_i$ exceeding the threshold voltage $V_{max}$, the LD power $Ld_i$ corresponding to the charging bias $Vc_i$ below the threshold voltage $V_{max}$ may be corrected.

Figure 20:
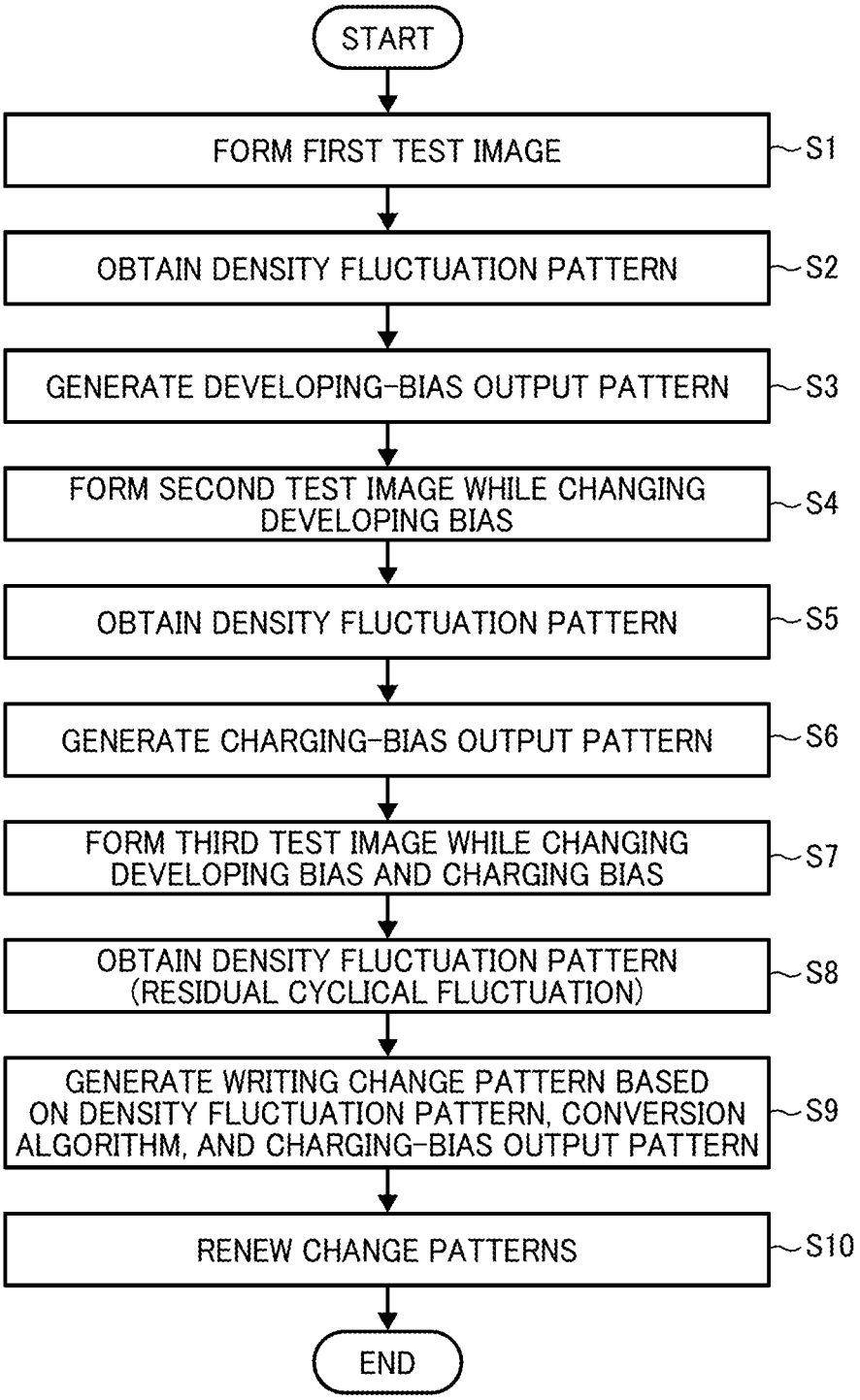
FIG. 20 is a flowchart of pattern generation performed by a controller according to an embodiment.

FIG. 20 is a flowchart of processing of the controller 110 to generate pattern data. Starting the generation processing, the controller 110 forms the first test image, which is a solid toner image, at S1 and obtains the density fluctuation pattern of the first test image at S2. Specifically, the controller 110 generates the graph of relation between the toner adhesion amount and time and extracts the density fluctuation pattern therefrom. At S3, the controller 110 generates a developing-bias change pattern (developing bias output pattern) to cause an image density fluctuation pattern to offset the density fluctuation pattern obtained at S2. At S4, while cyclically changing the developing bias based on the developing-bias change pattern generated at S3, the controller 110 forms the second test image and obtains the density fluctuation pattern of the second test image at S5. At S6, the controller 110 generates a charging-bias change pattern (charging-bias output pattern) to cause an image density fluctuation pattern to offset the density fluctuation pattern obtained at S5. Subsequently, under such conditions that the developing bias is cyclically changed based on the developing-bias change pattern (the group of normalized data) and the charging bias is cyclically changed based on the charging-bias change pattern (the group of normalized data), the controller 110 forms a third test image, which is a halftone toner image at S7. At S8, the controller 110 obtains the density fluctuation pattern of the third test image (residual cyclic fluctuation). At S9, based on the density fluctuation pattern obtained at S8, the above-described conversion algorithm, and the charging-bias change pattern, the controller 110 generates the writing change pattern. Specifically, after converting each data value of the density fluctuation pattern with the conversion algorithm to generate the tentative writing change pattern, the controller 110 corrects, according to the above-mentioned rule, the LD power data in the tentative writing change pattern, thereby generating the writing change pattern. At S10, the controller 110 renews the previous developing-bias change pattern, the charging-bias change pattern, and the writing change pattern stored in the storage device (e.g., the nonvolatile memory) to the latest patterns. The processing described above is performed for each of yellow, cyan, magenta, and black.

Specifically, in image formation according to a command from a user, based on the writing change pattern for photoconductor cycle, the writing change pattern for sleeve cycle, the photoconductor reference attitude timing, and the sleeve reference attitude timing, the controller 110 generates the following superimposed change pattern. More specifically, the superimposed change pattern is to generate a superimposed variation waveform in which the waveform of writing changes (to change writing power for latent image) in the photoconductor rotation cycle is superimposed with the waveform of writing changes in the sleeve rotation cycle. The controller 110 sequentially transmits the superimposed change pattern to the writing controller 125. The writing controller 125 changes the writing light amount cyclically based on the superimposed change pattern. Such processing is performed for each of yellow, cyan, magenta, and black.

Such a configuration can effectively suppress the residual cyclic fluctuation remaining even when the developing bias and the charging bias are cyclically changed.

Note that, as the cyclic change of the developing bias increases, fluctuates in halftone image density increase. Accordingly, the developing-bias change pattern is correlated with the charging-bias change pattern to a certain accuracy. In other words, the developing-bias change pattern is a correlative pattern correlated with the charging-bias change pattern. Accordingly, the tentative writing change pattern can be corrected based on the developing-bias change pattern instead of based on the charging-bias change pattern, to generate the writing change pattern.

Next, descriptions are given below of variations in which the configuration of the image forming apparatus (e.g., the copier 500) illustrated in FIG. 1 is modified. Other than the differences described below, the configuration of the copier 500 according to each variation described below is similar to the above-described configuration.

[Variation 1]

In the pattern generation, as the amplitude of density fluctuation pattern of the first test image formed of a solid toner image increases, the amplitude of the developing-bias change pattern increases. As the amplitude of the developing-bias change pattern increases, the amplitude of density fluctuation pattern of the second test image formed of a halftone toner image increases. Accordingly, the amplitude of the charging-bias change pattern increases. Therefore, the density fluctuation pattern of the first test image and the density fluctuation pattern of the second test image are correlative patterns having a certain correlation with the charging-bias change pattern (though opposite in phase from the charging-bias change pattern).

Therefore, in Variation 1, the controller 110 corrects the tentative writing change pattern based on the density fluctuation pattern of the second test image, instead of correction based on the charging-bias change pattern. Specifically, initially, based on the detection result of the density fluctuation pattern of the third test image, the controller 110 generates the formula of tentative writing change patterns for photoconductor cycle and the formula of that for sleeve cycle. Subsequently, from the density fluctuation pattern of the second test image, the controller 110 extracts, by frequency analysis, the density fluctuation pattern in the photoconductor rotation cycle and the density fluctuation pattern in the sleeve rotation cycle. The controller 110 converts the extracted fluctuation patterns into patterns in the reverse phase (i.e., density fluctuation patterns converted in reverse phase) with the amplitudes thereof kept unchanged. Subsequently, the controller 110 corrects each of the LD power (amplitude) $Ld_i$ calculated based on the formula of tentative writing change pattern for photoconductor cycle. Specifically, the controller 110 corrects each of the LD power $Ld_i$, as follows, based on each of image density (amplitude) $C_i$ calculated based on the formula of density fluctuation pattern converted in reverse phase. When the image density $C_i$ is greater than a threshold density $C_{max}$, $$Ld_i'=Ld_i(1+\alpha(C_i-C_{max}))$$

where $Ld_i$ represents the LD power, $Ld_i'$ represents a corrected LD power, $\alpha$ represents a coefficient to adjust the magnitude of $Ld_i$, and i is a number from 1 to x.

By contrast, when the image density $C_i$ is not greater than the threshold density $C_{max}$, $$Ld_i'=Ld_i.$$

With this configuration, of the LD power (amplitude) $Ld_i$ included in the tentative writing change pattern, only the LD power $Ld_i$ corresponding to the image density (amplitude) $C_i$ greater than the threshold density $C_{max}$ is corrected to a greater value. Thus, the controller 110 generates the data of writing change pattern constituted of a group of LD power data corrected as required. When the tentative writing change pattern is corrected based on the density fluctuation pattern of the second test image, the residual cyclic fluctuation is further suppressed. Note that, depending on the characteristics of optical attenuation of the photoconductor, instead of correcting the LD power $Ld_i$ corresponding to the image density (amplitude) $C_i$ exceeding the threshold density $C_{max}$, the LD power $Ld_i$ corresponding to the image density $C_i$ below the threshold density $C_{max}$ may be corrected.

Figure 21:
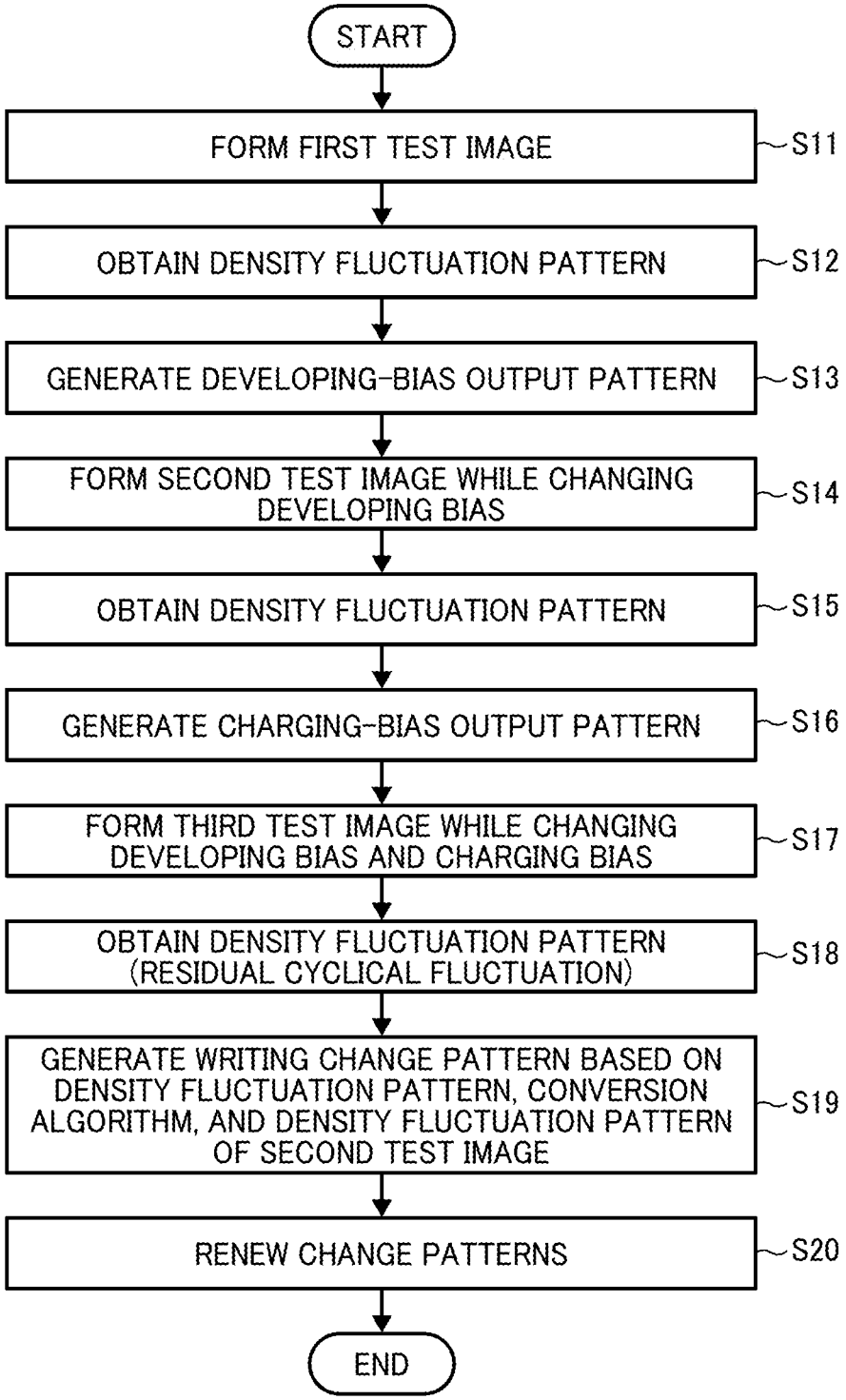
FIG. 21 is a flowchart of pattern generation performed by a controller according to Variation 1.

FIG. 21 is a flowchart of processing to generate the pattern data performed by the controller 110 according to Variation 1. Steps S11 to S18 and S20 in FIG. 21 are similar to steps S1 to S8 and S10 in FIG. 20. At S19, the controller 110 according to Variation 1 generates the tentative writing change pattern based on the density fluctuation pattern of the third test image. The controller 110 converts the density fluctuation pattern of the second test image into the reversed phase pattern and corrects each of the LD power value of the tentative writing change pattern according to the above-described rule, thereby generating the writing change pattern.

Note that, instead of correction based on the density fluctuation pattern of the second test image, the writing change pattern can be generated based on the correction based on the density fluctuation pattern of the first test image.

[Variation 2]

To attain a proper writing change pattern, instead of correcting the tentative writing change pattern based on the charging-bias change pattern or the like, the density fluctuation pattern of the third test image can be corrected based on the charging-bias change pattern or the like.

Therefore, in Variation 2, instead of correcting the tentative writing change pattern based on the charging-bias change pattern, the amplitude of detection results of density fluctuation pattern of the third test image is corrected based on the charging-bias change pattern, thereby generating the writing change pattern. Specifically, from the density fluctuation pattern of the third test image, the controller 110 extracts, by frequency analysis, the density fluctuation pattern in the photoconductor rotation cycle and the density fluctuation pattern in the sleeve rotation cycle. Additionally, from the density fluctuation pattern of the second test image, the controller 110 extracts, by frequency analysis, the density fluctuation pattern in the photoconductor rotation cycle and the density fluctuation pattern in the sleeve rotation cycle. Subsequently, the controller 110 corrects each density value (amplitude of cyclic component) $C_{3i}$, included in the density fluctuation pattern in the photoconductor rotation cycle of the third test image, based on each density value (amplitude of cyclic component) included in the density fluctuation pattern in the photoconductor rotation cycle of the second test image, as follows.

When an image density (amplitude) $C_{2i}$ is greater than the threshold density $C_{max}$, $$C_{3i}'=C_{3i}(1+\alpha(C_{2i}-C_{max}))$$

where $C_{3i}$ represents the image density (amplitude) of the third test image, $C_{3i}'$ represents a corrected image density (amplitude) of the third test image, $\alpha$ represents a coefficient to adjust the magnitude of $C_{3i}$, and i is a number from 1 to x.

By contrast, when the image density $C_{2i}$ is not greater than the threshold density $C_{max}$, $$C_{3i}'=C_{3i}.$$

Thus, each image density (amplitude) $C_{3i}$ of the third test image is corrected based on each image density (amplitude) $C_{2i}$ included in the density fluctuation pattern of the second test image, thereby obtaining a density fluctuation pattern corrected regarding the third test image. Subsequently, each image density (amplitude) $C_{3i}$ included in the density fluctuation pattern corrected regarding the third test image is converted into the Ld power $Ld_i$ according to the conversion algorithm, thereby generating the writing change pattern.

Alternatively, each image density (amplitude) $C_{3i}$ included in the density fluctuation pattern of the third test image can be corrected based on, instead of image density (amplitude) $C_{2i}$ in the density fluctuation pattern of the second test image, each image density (amplitude) $C_{1i}$ included in the density fluctuation pattern of the first test image.

Figure 22:
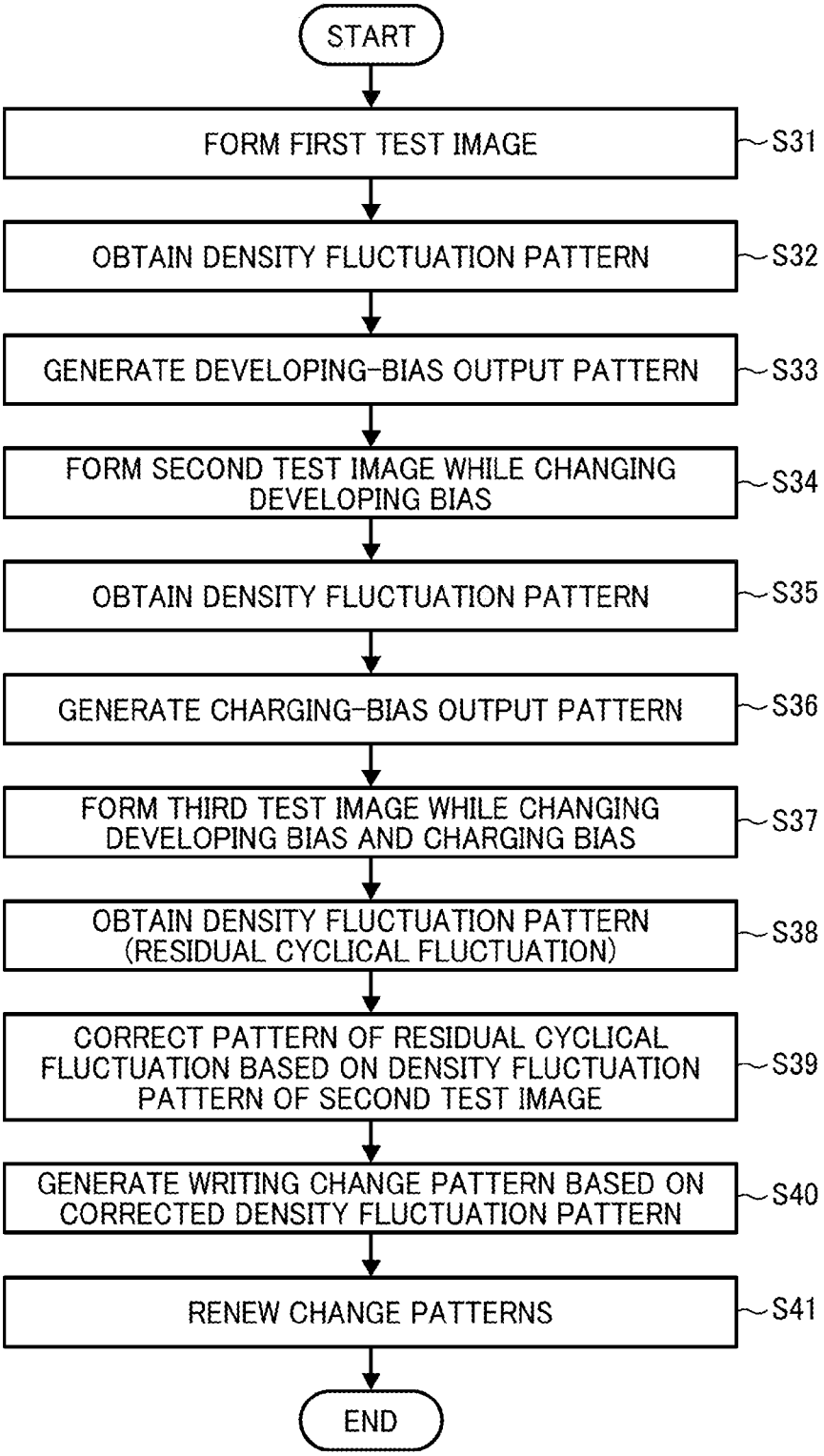
FIG. 22 is a flowchart of pattern generation performed by a controller according to Variation 2.

FIG. 22 is a flowchart of processing to generate the pattern data performed by the controller 110 according to Variation 2. Steps S31 to S38 and S41 in FIG. 22 are similar to steps S1 to S8 and S10 in FIG. 20. At S39 in FIG. 22, the controller 110 according to Variation 2 corrects the density fluctuation pattern of the third test image based on the density fluctuation pattern of the second test image. The detailed manner of correction is described above. At S40, the controller 110 generates the writing change pattern based on the corrected density fluctuation pattern.

[Variation 3]

To attain a proper writing change pattern, the density fluctuation pattern of the third test image can be corrected based on the charging-bias change pattern, instead of the density fluctuation pattern of the second test image.

In Variation 3, the density fluctuation pattern of the third test image is corrected based on the charging-bias change pattern, thereby generating the writing change pattern. Specifically, from the density fluctuation pattern of the third test image, the controller 110 extracts, by frequency analysis, the density fluctuation pattern in the photoconductor rotation cycle and the density fluctuation pattern in the sleeve rotation cycle. Subsequently, the controller 110 corrects each density value (amplitude) $C_{3i}$, included in the density fluctuation pattern in the photoconductor rotation cycle of the third test image, based on each charging bias (amplitude) $Vc_i$ based on the formula of charging-bias change pattern for photoconductor cycle, as follows.

When the charging bias $Vc_i$ is greater than the threshold voltage $V_{max}$, $$C_{3i}'=C_{3i}(1+\alpha(V_{ci}-V_{max}))$$

where $C_{3i}$ represents the image density (amplitude) of the third test image, $C_{3i}'$ represents a corrected image density (amplitude) of the third test image, $\alpha$ represents a coefficient to adjust the magnitude of $C_{3i}$, and i is a number from 1 to x.

By contrast, when the charging bias $Vc_i$ is not greater than the threshold voltage $V_{max}$, $$C_{3i}'=C_{3i}.$$

Thus, each image density (amplitude) $C_{3i}$ of the density fluctuation pattern of the third test image is corrected based on each charging bias (amplitude) $Vc_i$ based on the formula of charging-bias change pattern, thereby obtaining a density fluctuation pattern corrected regarding the third test image. Subsequently, each image density (amplitude) $C_{3i}'$ included in the density fluctuation pattern corrected regarding the third test image is converted into the Ld power $Ld_i$ according to the conversion algorithm, thereby generating the writing change pattern.

Alternatively, each image density (amplitude) $C_{3i}$ included in the density fluctuation pattern of the third test image can be corrected based on the developing-bias change pattern, instead of the charging-bias change pattern.

Figure 23:
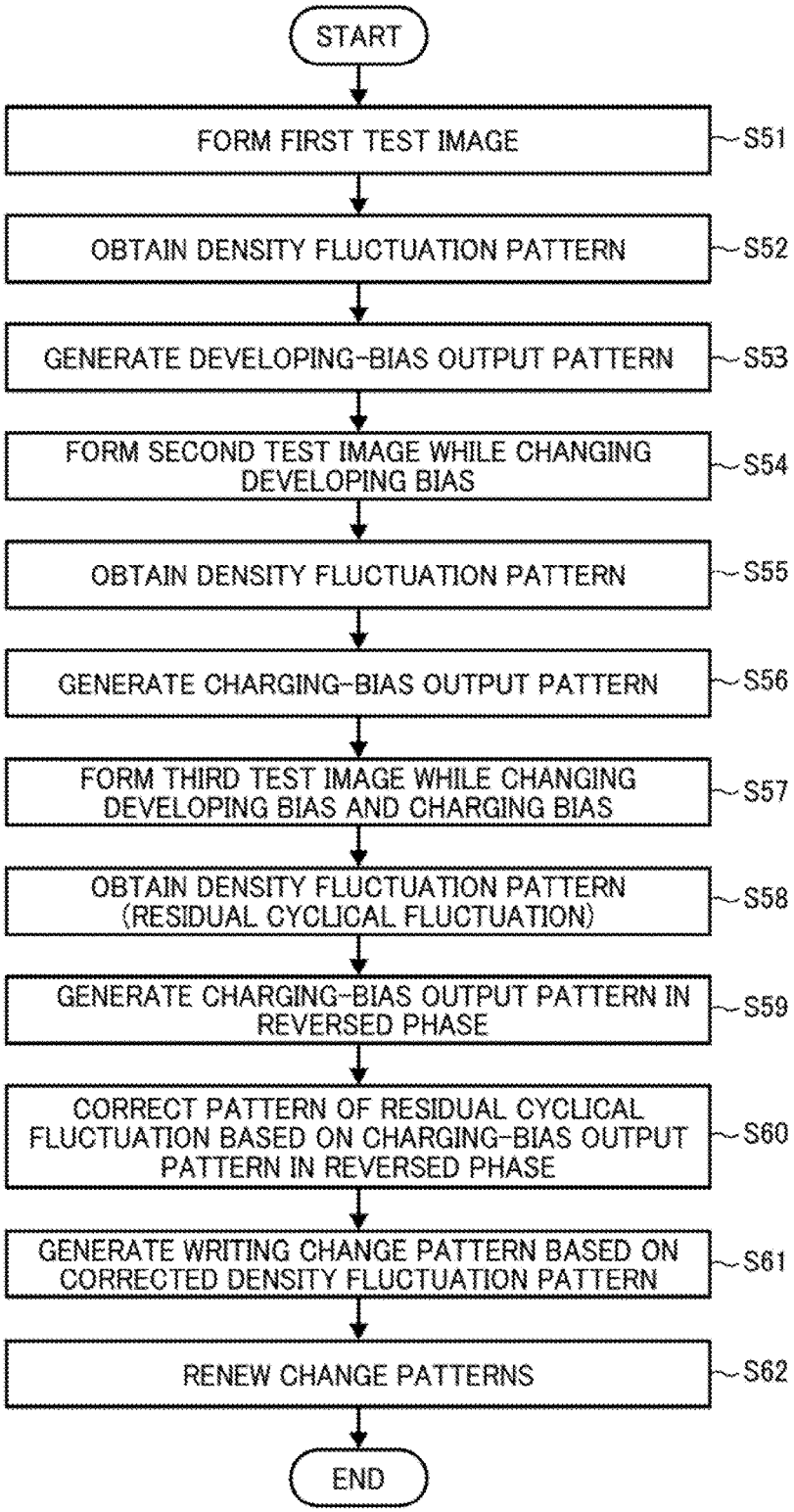
FIG. 23 is a flowchart of pattern generation performed by a controller according to Variation 3.

FIG. 23 is a flowchart of processing to generate the pattern data performed by the controller 110 according to Variation 3. Steps S51 to S58, S61, and S62 in FIG. 23 are similar to steps S31 to S38, S40, and S41 in FIG. 22. At S59 in FIG. 23, based on the charging-bias change pattern generated at S56, the controller 110 according to Variation 3 generates a reversed phase pattern thereof (i.e., charging-bias change pattern in reversed phase). At S60, the controller 110 corrects the density fluctuation pattern of the third test image based on the charging-bias change pattern in reversed phase. The detailed manner of correction is described above. At S61, the controller 110 generates the writing change pattern based on the corrected density fluctuation pattern.

[Variation 4]

In Variation 4, each image density (amplitude) $C_{3i}$ of the density fluctuation pattern of the third test image is corrected based on each charging bias (amplitude) $Vc_i$ based on the formula of charging-bias change pattern, as follows.

When the charging bias $Vc_i$ is greater than the threshold voltage $V_{max}$, $$D_{3i}'=D_{3i}(1+\alpha(V_{ci}-V_{max}))$$

where $D_{3i}$ represents the image density (amplitude) of the third test image, $D_{3i}'$ represents a corrected image density (amplitude) of the third test image, $\alpha$ represents a coefficient to adjust the magnitude of $D_{3i}$, and i is a number from 1 to x.

By contrast, when the charging bias $Vc_i$ is not greater than the threshold voltage $V_{max}$, $$D_{3i}'=D_{3i}.$$

Figure 24:
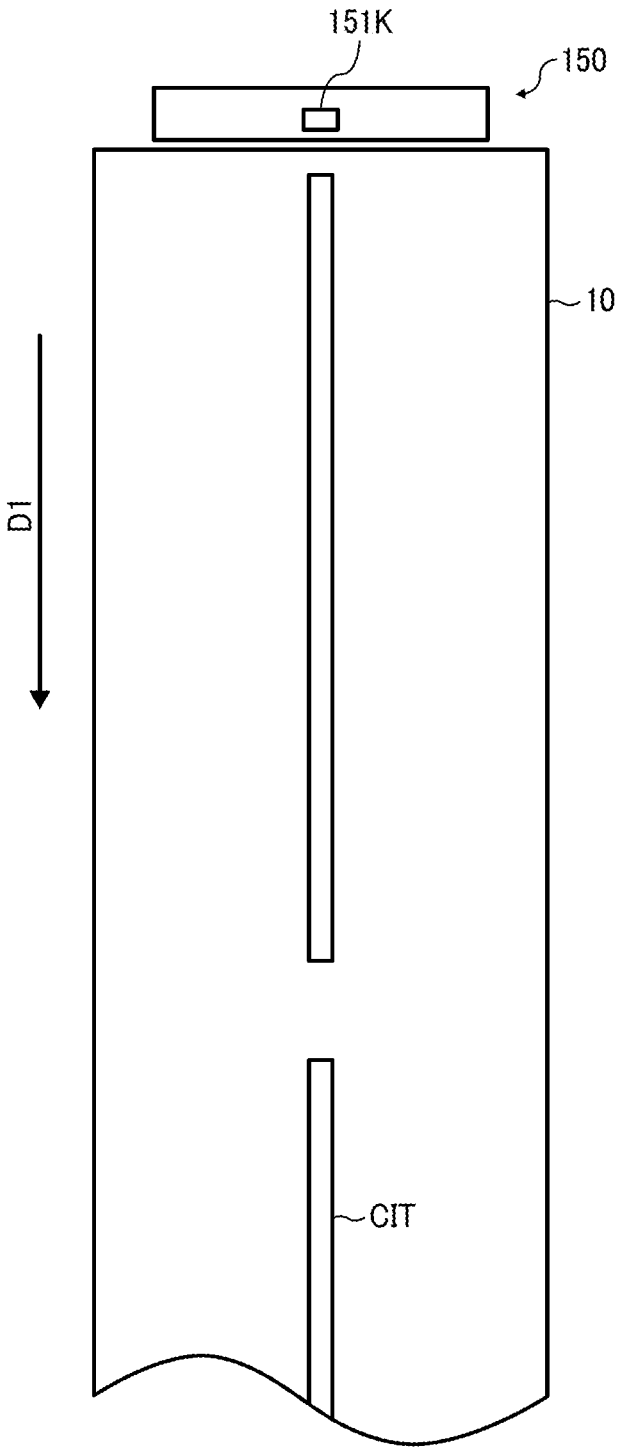
FIG. 24 is a schematic view of an image forming apparatus including a detector to detect a test toner image according to another embodiment.

Although, in the description above, the optical sensor unit 150 employs the four reflective photosensors to individually detect the toner adhesion amounts of yellow, cyan, magenta, and black toner images, the number of reflective photosensors is not necessarily identical to the number of colors used. For example, in an embodiment illustrated in FIG. 24, a single reflective photosensor 151K detects the adhesion amounts of yellow, cyan, magenta, and black toners.

Figure 25:
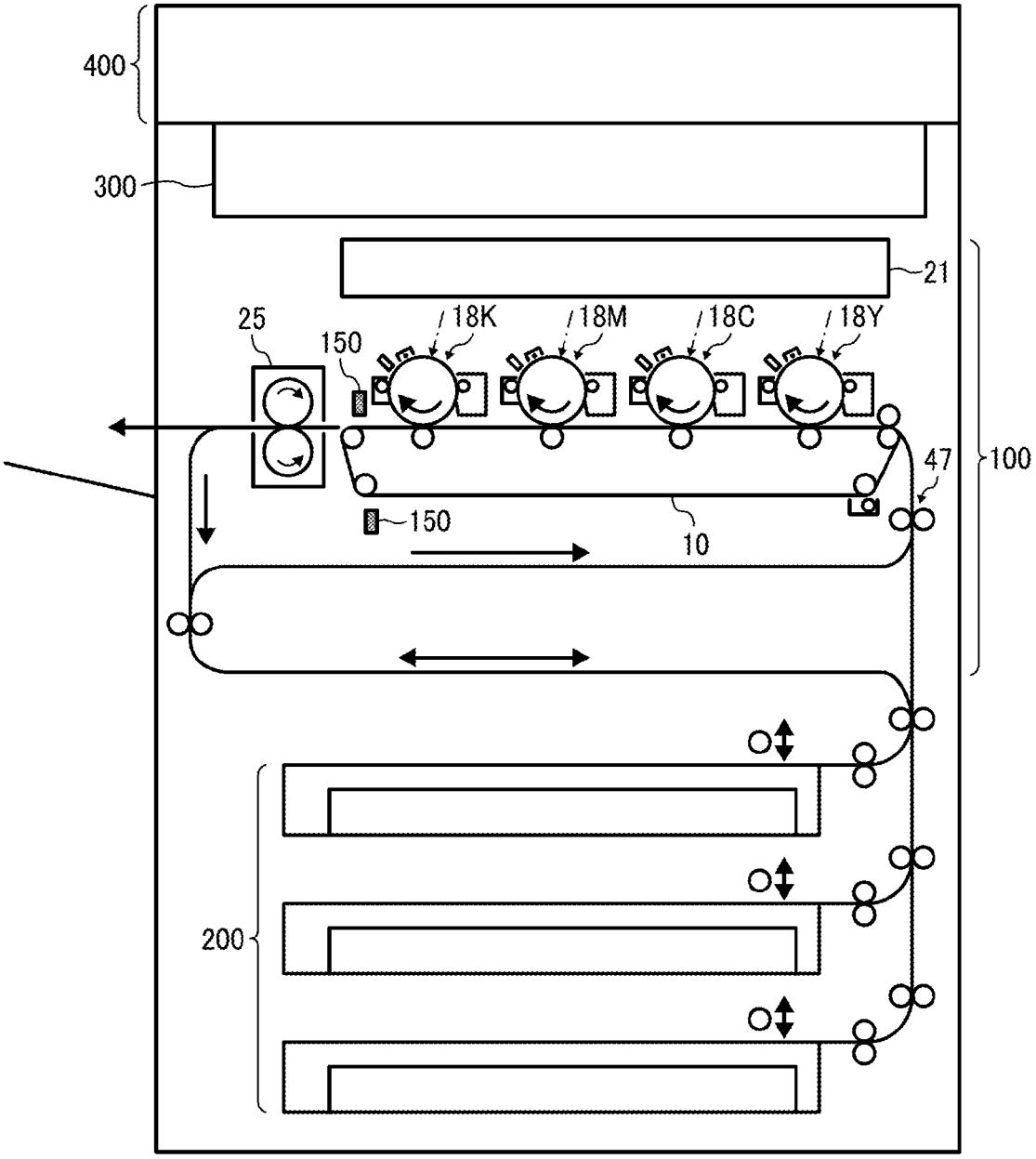
FIG. 25 is a schematic view of an image forming apparatus according to another embodiment.

Although, in the description above, the toner image on the photoconductor 20 is primarily transferred to the intermediate transfer belt 10 and secondarily transferred to the recording sheet, one or more aspects of the present disclosure are applicable to a structure in which the toner image is directly transferred from the photoconductor 20 onto the recording sheet, as illustrated in FIG. 25.

Figure 26:
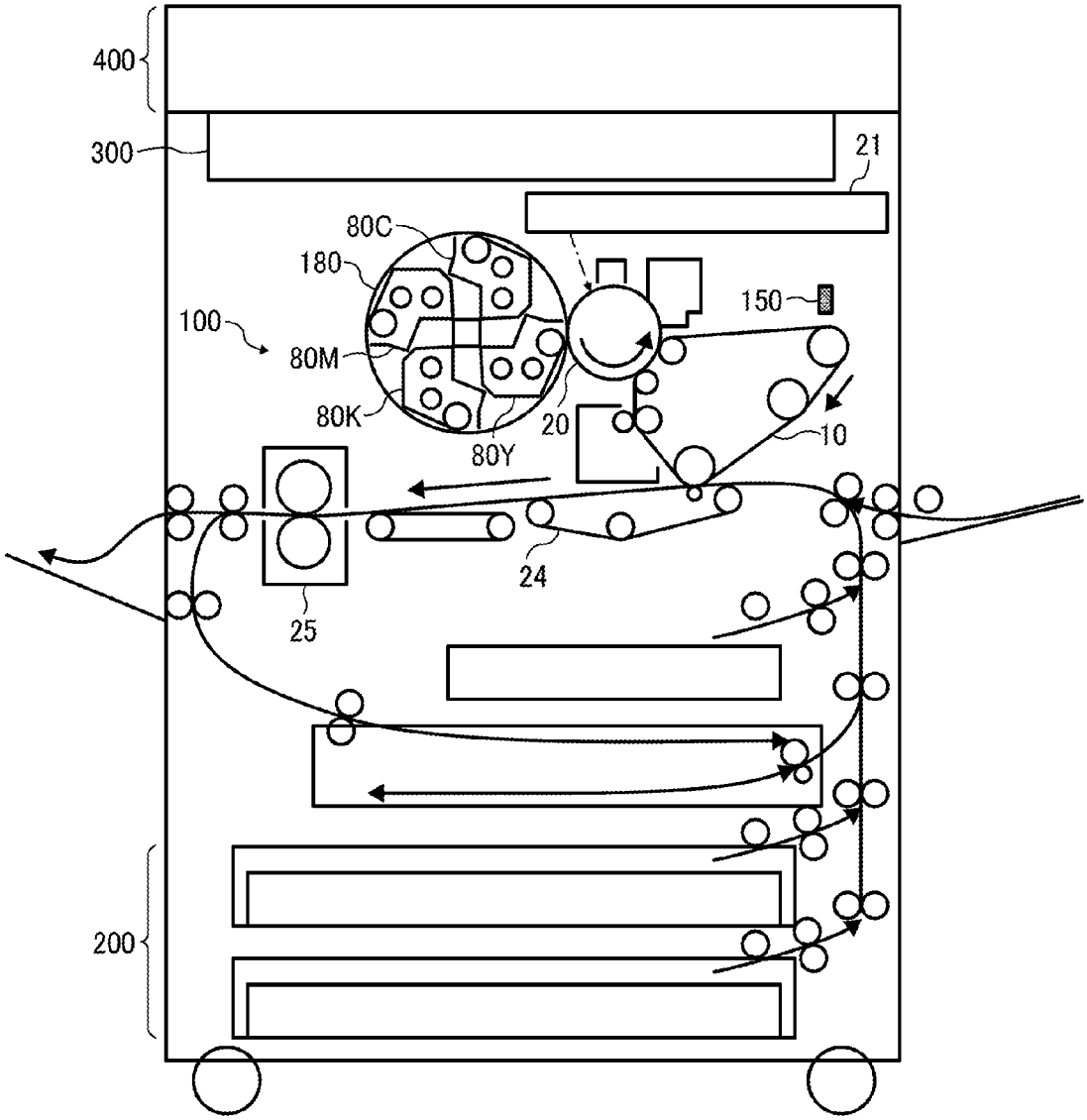
FIG. 26 is a schematic view of an image forming apparatus according to another embodiment.

Although an example structure including four photoconductors respectively corresponding to yellow, cyan, magenta, and black toner images is described above, one or more aspects of the present disclosure are applicable to a structure in which bicolor or three-color toner images are formed using a single photoconductor. For example, the structure illustrated in FIG. 26 includes a single photoconductor 20 common to yellow, cyan, magenta, and black. This configuration includes a revolver developing device 180 to revolve the developing devices 80Y, 80C, 80M, and 80K about a revolution axis. The revolver developing device 180 is disposed on the side of the photoconductor 20 common to the four colors. In the process of sequentially writing the electrostatic latent images for yellow, cyan, magenta, and black on the photoconductor 20, while rotating the revolver developing device 180 as required, the electrostatic latent images are developed. In a process of rotating the intermediate transfer belt 10 more than four turns, in each turn, the yellow, cyan, magenta, and black toner images thus developed are primarily transferred are superimposed on the intermediate transfer belt 10. Then, the four-color superimposed toner image is secondarily transferred onto the recording sheet.

Application of aspects of the present disclosure is not limited to the example embodiments described above, but various modification and change are possible. For example, image forming apparatuses to which one or more aspects of the present disclosure are applicable include printers, facsimile machines, and multifunction peripherals (MFPs) in addition to copiers. Further, one or more aspects of the present disclosure are applicable to not only color image forming apparatuses but also monochrome or single-color image forming apparatuses. Further, one or more aspects of the present disclosure are applicable to not only image forming apparatuses dedicated to single-side printing but also image forming apparatuses capable of double-side printing. Examples of recording sheet include plain paper, overhead projector (OHP) transparency, cards, postcards, thick sheets, envelopes, and the like.

The configurations described above are just examples, and each of the following aspects of this specification attains a specific effect.

Aspect A

Aspect A concerns an image forming apparatus (e.g., the copier 500) that includes an image forming device (e.g., the image forming unit 18) including a latent image bearer (e.g., the photoconductor 20), a charger (e.g., the charging roller 71) to charge the surface of the latent image bearer, a latent-image writing device (e.g., the laser writing device 21) to write a latent image on the charged surface of the latent image bearer, and a developing device (e.g., the developing device 80) to develop the latent image with developer borne on a developer bearer (e.g., the developing sleeve 81). The image forming apparatus further includes an output change device (e.g., the controller 110) to cyclically change a charging power based on a charging change pattern and a developing bias, applied to the developer bearer, based on a developing change pattern, during image formation by the image forming unit. The output change device causes the image forming device to form a test toner image for pattern generation, on the latent image bearer while cyclically changing the charging power based on the charging change pattern and the developing bias based on the developing change pattern. The output change device is configured to perform pattern generation processing to generate a writing change pattern to cyclically change the power of latent image writing, by the latent-image writing device, based on an image density fluctuation pattern of the test toner image for pattern generation and one of the charging change pattern and a correlative pattern correlated with the charging change pattern. The image density fluctuation pattern is detected in the rotation direction of the latent image bearer. The output change device cyclically changes the power of latent image writing based on the writing change pattern during image formation according to a user command.

Aspect A addresses cyclic image density fluctuations (i.e., residual cyclic fluctuation, remaining in, e.g., in the third test image) occurring even when the developing bias and the charging power are cyclically changed. When the power of latent image writing is cyclically changed according to the writing change pattern generated based on the detection result of such image density fluctuations, the residual cyclic fluctuation can be suppressed.

Aspect B

In Aspect A, prior to generating the writing change pattern using the test toner image for pattern generation (e.g., the third test image), the output change device causes the image forming device to form a first test toner image (e.g., the first test image) without cyclically changing the developing bias, the charging power, and the power of latent image writing and generates the developing change pattern based on an image density fluctuation pattern of the first test toner image, detected in the rotation direction of the latent image bearer. Then, the output change device causes the image forming device to form a second test toner image (e.g., the second test image) while cyclically changing the developing bias, without cyclically changing the charging power and the power of latent image writing. Then, the output change device generates the charging change pattern based on an image density fluctuation pattern of the second test toner image, detected in the rotation direction of the latent image bearer. This configuration can generate a developing-bias change pattern capable of suppressing cyclic density fluctuations in high-density images. Subsequently, a charging change pattern capable of suppressing cyclic density fluctuations in low-density images resulting from cyclically changing the developing bias based on the developing change pattern.

Aspect C

In Aspect B, the output change device is configured to set the second test image lower in image density than the first test image. With this configuration, the density fluctuation pattern of the second test image serves as the density fluctuation pattern of the low-density images resulting from cyclically changing the developing bias based on the developing change pattern.

Aspect D

In Aspect B or C, the output change device is configured to generate the writing change pattern based on the detected image density fluctuation pattern of the test toner image for pattern generation in the rotation direction of the latent image bearer and one of the charging change pattern and the developing change pattern (the correlative pattern). This configuration enables the writing change pattern to cyclically change the power of latent image writing so that the residual cyclic fluctuation is suppressed.

Aspect E

In Aspect B or C, the output change device is configured to generate the writing change pattern based on the detected image density fluctuation pattern of the test toner image for pattern generation in the rotation direction of the latent image bearer and one of the image density fluctuation pattern of the second test image (the correlative pattern) and the image density fluctuation pattern of the first test image (the correlative pattern). Similarly, this configuration enables the writing change pattern to cyclically change the power of latent image writing so that the residual cyclic fluctuation is suppressed.

Aspect F

In Aspect B or C, the output change device is configured to correct the detected image density fluctuation pattern of the third test toner image in the rotation direction of the latent image bearer based on one of the charging change pattern and the developing change pattern (the correlative pattern) and generate the writing change pattern based on a corrected image density fluctuation pattern of the test toner image for pattern generation. Similarly, this configuration enables the writing change pattern to cyclically change the power of latent image writing so that the residual cyclic fluctuation is suppressed.

Aspect G

In Aspect B or C, the output change device is configured to correct the detected image density fluctuation pattern of the test toner image for pattern generation in the rotation direction of the latent image bearer based on one of the image density fluctuation pattern of the second test image (the correlative pattern) and the image density fluctuation pattern of the first test image (the correlative pattern) and generate the writing change pattern based on a corrected image density fluctuation pattern of the test toner image for pattern generation. Similarly, this configuration enables the writing change pattern to cyclically change the power of latent image writing so that the residual cyclic fluctuation is suppressed.

Aspect H

In any one of Aspects B to G, the latent image bearer is a photoconductor, the latent-image writing device is configured to irradiate the latent image bearer with light to form the latent image, and the power of latent image writing is represented as the irradiation light amount per unit area. Cyclically changing the amount of irradiation light is effective in suppressing the image density fluctuations remaining even when the developing bias and the charging power are cyclically changed, as the inventors have found experimentally.

Aspect I

In any one of Aspects B to H, the image forming apparatus further includes a rotation attitude sensor (e.g., the photoconductor rotation sensor 76 and the sleeve rotation sensor 83) to detect a rotation attitude of the rotator (e.g., the photoconductor 20 or the developing sleeve 81) that causes, by rotation, the cyclic image density fluctuation. The output change device is configured to generate each of the developing change pattern, the charging change pattern, and the writing change pattern with reference to a reference timing in one rotation of the rotator, detected by the rotation attitude sensor. Further, the output change device is configured to cyclically change the developing bias, the charge intensity, and the power of latent image writing, based on the detection result generated by the rotation attitude sensor, during the image formation according to the user command. This configuration can suppress the cyclic image density fluctuation occurring in the rotation cycle of the rotator.

Aspect J

In Aspect I, the output change device is configured to cause the image forming device to form, as each of the first test image, the second test image, and the test toner image for pattern generation, a toner image having a length, in the rotation direction of the latent image bearer, not shorter than a length of circumference of the rotator. With this configuration, each of the first test image, the second test image, and the test toner image for pattern generation is applicable to detect the image density fluctuation pattern throughout the rotation cycle.

Aspect K

In any one of Aspects B to J, the image forming apparatus further includes a replacement detector (e.g., the unit mount sensor 17) to detect replacement of the rotator, and the output change device is configured to perform the pattern generation processing in response to detection of replacement detected by the replacement detector. With this configuration, the output change device can renew each of the developing change pattern, the charging change pattern, and the writing change pattern, which may become improper upon replacement of the rotator.

Aspect L

In any one of Aspects B to K, the image forming apparatus further includes an environment sensor (e.g., the environment sensor 124) to detect an environmental change, and the output change device is configured to perform the pattern generation processing in response to detection of the environmental change, detected by the environment sensor. With this configuration, the output change device can renew each of the developing change pattern, the charging change pattern, and the writing change pattern, which may become improper upon the environmental change.

Aspect M

Aspect M concerns an image forming method that includes image formation and output changing during image formation. The image formation includes charging a surface of a latent image bearer, forming a latent image on a charged surface of the latent image bearer, and developing the latent image with developer borne on a developer bearer. The output changing includes cyclically changing a charging power based on a charging change pattern and a developing bias, applied to the developer bearer, based on a developing change pattern.

The method further includes forming a test toner image for pattern generation, on the latent image bearer while cyclically changing the charging power based on the charging change pattern and the developing bias based on the developing change pattern. The method further includes generating an image density fluctuation pattern of the test toner image for pattern generation in the rotation direction of the latent image bearer and generating a writing change pattern to cyclically change the power of latent image writing, by the latent-image writing device, based on the image density fluctuation pattern of the test toner image for pattern generation and one of the charging change pattern and a correlative pattern correlated with the charging change pattern. The method further includes cyclically changing the power of latent image writing based on the writing change pattern during image formation according to a user command.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. An image forming apparatus comprising:

an image forming device including:

a latent image bearer, a charger to charge a surface of the latent image bearer;

a latent-image writing device to write a latent image on the charged surface of the latent image bearer, and a developing device including a developer bearer to bear developer to develop the latent image;

an image density detector to detect a density of an image formed by the image forming device; and an output change device to cyclically change a charging power and a developing bias applied to the developer bearer during image formation by the image forming device, the output change device configured to:

cause the image forming device to form a test toner image for pattern generation, on the latent image bearer, while cyclically changing the charging power based on a charging change pattern and the developing bias based on a developing change pattern;

generate, based on a detection result of the image density detector, an image density fluctuation pattern of the test toner image for pattern generation, the image density fluctuation pattern generated in a rotation direction of the latent image bearer;

perform pattern generation processing to generate a writing change pattern to cyclically change a power of latent image writing by the latent-image writing device, based on the image density fluctuation pattern of the test toner image for pattern generation, and one of the charging change pattern and a correlative pattern correlated with the charging change pattern; and cyclically change the power of latent image writing based on the writing change pattern during image formation according to a user command.

2. The image forming apparatus according to claim 1, wherein, prior to generating the writing change pattern using the test toner image for pattern generation, the output change device is configured to:

cause the image forming device to form a first test toner image without cyclically changing the developing bias, the charging power, and the power of latent image writing;

generate the developing change pattern based on an image density fluctuation pattern of the first test toner image in the rotation direction of the latent image bearer;

cause the image forming device to form a second test toner image while cyclically changing the developing bias, without cyclically changing the charging power and the power of latent image writing; and generate the charging change pattern based on an image density fluctuation pattern of the second test toner image in the rotation direction of the latent image bearer.

3. The image forming apparatus according to claim 2, wherein the output change device is configured to set the second test toner image lower in image density than the first test toner image.

4. The image forming apparatus according to claim 2, wherein the output change device is configured to generate the writing change pattern based on the image density fluctuation pattern of the test toner image for pattern and one of the charging change pattern and the developing change pattern.

5. The image forming apparatus according to claim 2, wherein the output change device is configured to generate the writing change pattern based on the image density fluctuation pattern of the test toner image for pattern generation and the correlative pattern, and wherein the correlative pattern is one of the image density fluctuation pattern of the second test toner image and the image density fluctuation pattern of the first test toner image.

6. The image forming apparatus according to claim 2, wherein the output change device is configured to:

correct the image density fluctuation pattern of the test toner image for pattern generation based on one of the charging change pattern and the developing change pattern as the correlative pattern, and generate the writing change pattern based on a corrected image density fluctuation pattern of the test toner image for pattern generation.

7. The image forming apparatus according to claim 2, wherein the output change device is configured to:

correct the image density fluctuation pattern of the test toner image for pattern generation based on the correlative pattern, and generate the writing change pattern based on a corrected image density fluctuation pattern of the test toner image for pattern generation, and wherein the correlative pattern is one of the image density fluctuation pattern of the second test toner image and the image density fluctuation pattern of the first test toner image.

8. The image forming apparatus according to claim 2, wherein the latent image bearer is a photoconductor, wherein the latent-image writing device is configured to irradiate the latent image bearer with light to form the latent image, and wherein the power of latent image writing is represented as an irradiation light mount per unit area.

9. The image forming apparatus according to claim 2, further comprising a rotation attitude sensor to detect a rotation attitude of a rotator being at least one of the latent image bearer and the developer bearer, wherein the output change device is configured to:

detect a reference timing in one rotation of the rotator based on a detection output from the rotation attitude sensor;

generate each of the developing change pattern, the charging change pattern, and the writing change pattern with reference to the reference timing detected by the rotation attitude sensor, and cyclically change the developing bias, the charge intensity, and the power of latent image writing based on the detection output from the rotation attitude sensor, during image formation according to the user command.

10. The image forming apparatus according to claim 9, wherein, in the rotation direction of the latent image bearer, each of the first test toner image, the second test toner image, and the test toner image for pattern generation is not shorter than a length of circumference of the rotator.

11. The image forming apparatus according to claim 2, further comprising a replacement detector to detect replacement of at least one of the latent image bearer and the developer bearer, wherein the output change device is configured to perform the pattern generation processing in response to detection of replacement detected by the replacement detector.

12. The image forming apparatus according to claim 2, further comprising an environment sensor to detect an environmental change, wherein the output change device is configured to determine a timing to start the pattern generation processing based on detection of the environmental change, detected by the environment sensor.

13. An image forming method comprising:

forming a test toner image for pattern generation, on a latent image bearer while cyclically changing a charging power based on a charging change pattern and a developing bias applied to a developer bearer based on a developing change pattern;

generating an image density fluctuation pattern of the test toner image for pattern generation in a rotation direction of the latent image bearer;

generating a writing change pattern to cyclically change a power of latent image writing based on the image density fluctuation pattern of the test toner image for pattern generation and one of the charging change pattern and a correlative pattern correlated with the charging change pattern; and performing output change processing during image formation according to a user command, the output change processing including:

cyclically changing the charging power based on the charging change pattern;

cyclically changing the developing bias based on the developing change pattern; and cyclically changing the power of latent image writing based on the writing change pattern.

* * * * *